US008246095B2

(12) United States Patent
Radle et al.

(10) Patent No.: US 8,246,095 B2
(45) Date of Patent: Aug. 21, 2012

(54) CABLE CLASP

(75) Inventors: Patrick J. Radle, Mequon, WI (US); David J. Prince, Eau Claire, WI (US); Christopher L. Peterson, Chippewa Falls, WI (US); Joseph M. Hillary, Eden Prairie, MN (US)

(73) Assignee: Actuant Corporation, Menomonee Falls, WI (US)

( * ) Notice: Subject to any disclaimer, the term of this patent is extended or adjusted under 35 U.S.C. 154(b) by 405 days.

(21) Appl. No.: 12/504,470

(22) Filed: Jul. 16, 2009

(65) Prior Publication Data

US 2010/0201144 A1 Aug. 12, 2010

Related U.S. Application Data

(60) Provisional application No. 61/151,420, filed on Feb. 10, 2009.

(51) Int. Cl.
*B65D 63/18* (2006.01)
*A45F 5/00* (2006.01)

(52) U.S. Cl. ..... 294/165; 294/166; 294/169; 24/16 R; 24/272

(58) Field of Classification Search ..... 294/31.2, 294/150, 156, 165, 166, 169; 24/16 R, 16 PB, 24/272, 30.5 R; 70/16
See application file for complete search history.

(56) References Cited

U.S. PATENT DOCUMENTS

| | | | |
|---|---|---|---|
| 151,452 | A | 5/1874 | Tower |
| 7,873 | A | 9/1877 | Phelps |
| 200,950 | A | 3/1878 | Tower et al. |
| 222,751 | A | 12/1879 | Tower et al. |
| 470,869 | A | 3/1892 | Kahlke |
| 636,589 | A | 11/1899 | Tower |
| 686,626 | A | 11/1901 | Maltby |
| 732,417 | A | 6/1903 | Judd |
| 766,263 | A | 8/1904 | Judd |
| 772,468 | A | 10/1904 | Maltby |
| 827,385 | A | 7/1906 | Olcott |
| 870,871 | A | 11/1907 | Eggleton |
| 929,910 | A | 8/1909 | Wood |
| 930,014 | A | 8/1909 | Wood |
| 948,310 | A | 2/1910 | Caveney |
| 985,560 | A | 2/1911 | Widmayer |
| 1,000,666 | A | 8/1911 | Caveney |

(Continued)

FOREIGN PATENT DOCUMENTS

| | | |
|---|---|---|
| GB | 0758160 | 10/1956 |

(Continued)

*Primary Examiner* — Dean Kramer
(74) *Attorney, Agent, or Firm* — Quarles & Brady LLP

(57) ABSTRACT

A cable clasp comprises a tail including an engagement face. The cable clasp further comprises a head including a handle that connects to the tail and defines a mouth opening into which the tail is movable. The cable clasp is biased towards a closed-loop position in which at least a portion of the tail is disposed in the mouth opening. The head further includes a lock having a catch engageable with the engagement face in a lock position to: 1) prevent motion of the tail relative to the head in a first direction, and 2) permit motion of the tail relative to the head in a second direction opposite the first direction by sliding the catch over the engagement face. The catch and the engagement face are also disengageable in a release position to permit motion of the tail relative to the head in both the first and second directions.

12 Claims, 16 Drawing Sheets

U.S. PATENT DOCUMENTS

| | | | | |
|---|---|---|---|---|
| 1,014,118 | A | | 1/1912 | Carberry |
| 1,038,492 | A | | 9/1912 | Lorey |
| 1,401,854 | A | | 12/1921 | Almedia |
| 3,146,614 | A | | 9/1964 | Von Frantzius |
| 3,310,852 | A | | 3/1967 | Flanders |
| 3,429,985 | A | | 2/1969 | Czigler |
| 3,530,543 | A | | 9/1970 | Desmarais et al. |
| 3,574,900 | A | | 4/1971 | Emery |
| 3,654,668 | A | | 4/1972 | Appleton |
| 3,794,370 | A | * | 2/1974 | Lockhart et al. ..... 294/31.2 |
| 3,910,280 | A | | 10/1975 | Talonn |
| 3,913,187 | A | | 10/1975 | Okuda |
| 3,953,911 | A | | 5/1976 | Fishack |
| 4,123,095 | A | | 10/1978 | Stehlin |
| 4,278,042 | A | | 7/1981 | Lindquist |
| 4,340,998 | A | | 7/1982 | Liberge |
| 4,361,938 | A | | 12/1982 | Emery |
| 4,380,101 | A | | 4/1983 | Joubert et al. |
| 4,478,381 | A | | 10/1984 | Pittion et al. |
| 4,483,556 | A | | 11/1984 | LiVolsi |
| 4,511,164 | A | | 4/1985 | Orchard |
| 4,650,925 | A | | 3/1987 | Coldren |
| 4,656,566 | A | * | 4/1987 | Kelley ..... 362/202 |
| 4,669,688 | A | | 6/1987 | Itoh et al. |
| 4,870,722 | A | | 10/1989 | Shell, Jr. |
| 4,956,897 | A | | 9/1990 | Speedie |
| 4,958,791 | A | | 9/1990 | Nakamura |
| 4,991,265 | A | | 2/1991 | Campbell et al. |
| 5,042,114 | A | * | 8/1991 | Parrish ..... 24/16 PB |
| 5,056,248 | A | | 10/1991 | Blanchard |
| 5,083,741 | A | | 1/1992 | Sancoff |
| 5,210,911 | A | | 5/1993 | Brown et al. |
| 5,228,174 | A | | 7/1993 | Beasley |
| 5,317,788 | A | | 6/1994 | Esposito et al. |
| 5,349,779 | A | | 9/1994 | Ben-Dror |
| 5,377,510 | A | | 1/1995 | Smith |
| D377,444 | S | | 1/1997 | Lin |
| 5,729,872 | A | | 3/1998 | Ginocchio |
| 5,774,945 | A | | 7/1998 | Ginocchio |
| 5,794,461 | A | | 8/1998 | Smith |
| 6,101,684 | A | | 8/2000 | Ginocchio |
| 6,151,998 | A | | 11/2000 | Fu-Hui |
| 6,196,033 | B1 | | 3/2001 | Dowdle |
| D448,633 | S | | 10/2001 | Langlois |
| D454,045 | S | | 3/2002 | Rinner et al. |
| 6,619,077 | B1 | | 9/2003 | Robinson |
| 6,742,223 | B1 | | 6/2004 | Chang |
| D521,366 | S | | 5/2006 | Polak et al. |
| 7,143,480 | B2 | | 12/2006 | Igarashi |
| D557,584 | S | | 12/2007 | Gao |
| D580,748 | S | | 11/2008 | Polak et al. |
| D608,191 | S | | 1/2010 | Radle et al. |
| 7,900,324 | B2 | | 3/2011 | Ginocchio |
| 2003/0088948 | A1 | * | 5/2003 | Cook ..... 24/16 PB |
| 2006/0012199 | A1 | * | 1/2006 | Slank ..... 294/150 |
| 2007/0152460 | A1 | * | 7/2007 | Bauer ..... 294/150 |
| 2011/0131769 | A1 | | 6/2011 | Ginocchio |

FOREIGN PATENT DOCUMENTS

| | | | |
|---|---|---|---|
| GB | 2139016 | A | 10/1984 |
| GB | 2245639 | A | 1/1992 |

* cited by examiner

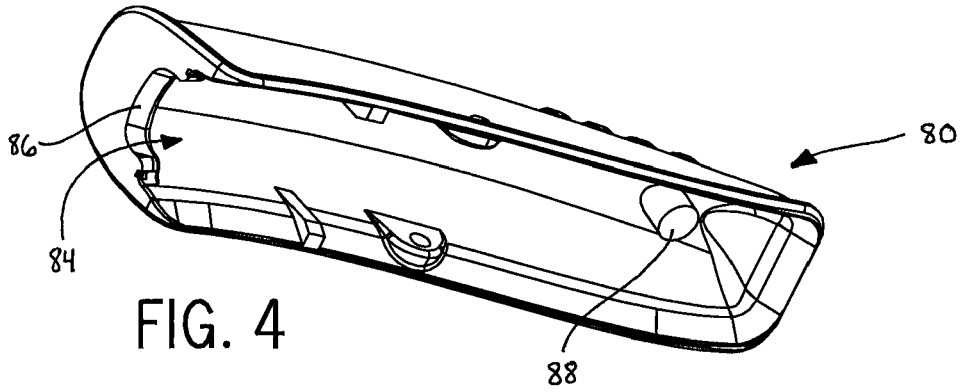
FIG. 4
FIG. 5
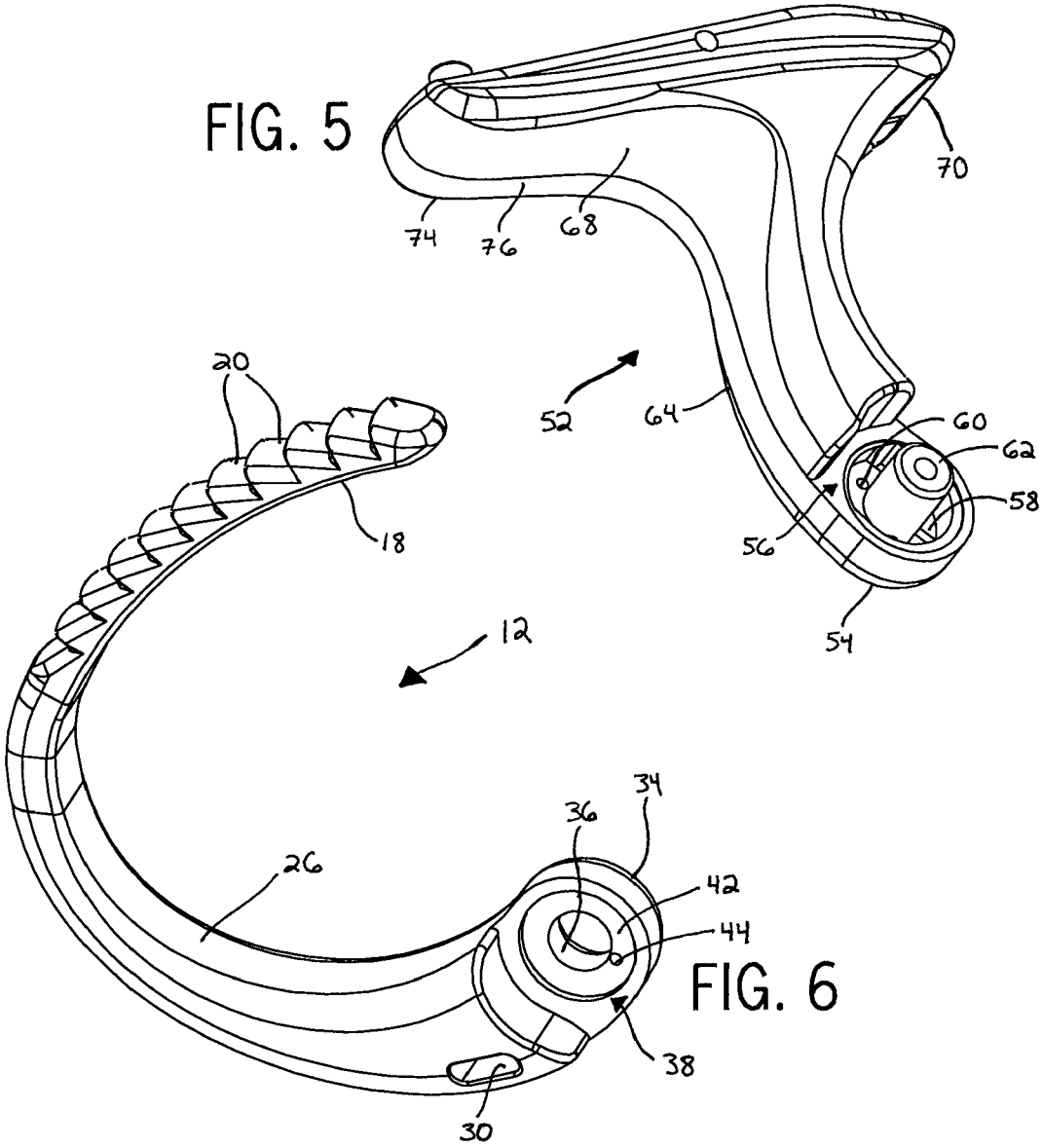
FIG. 6

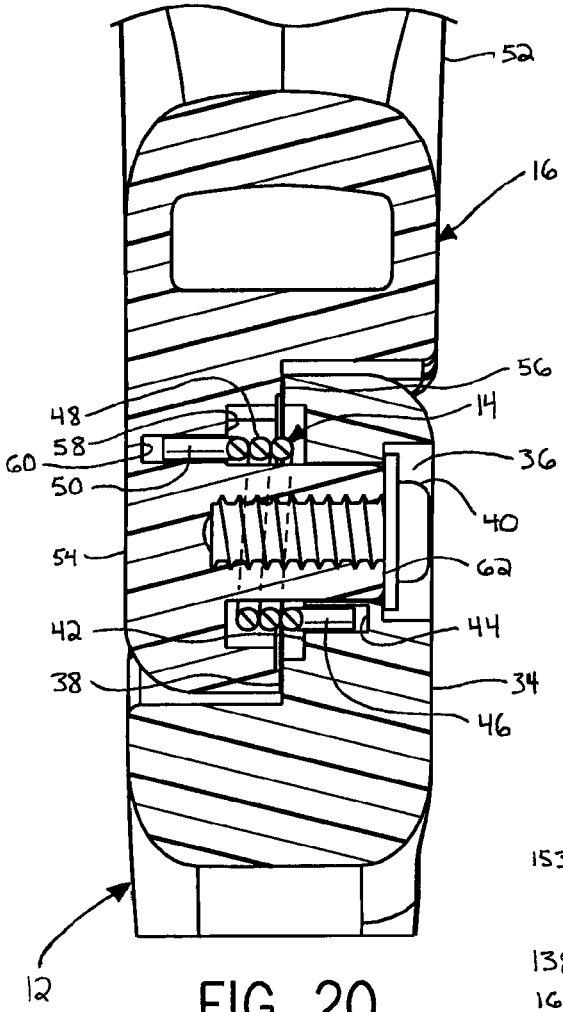
FIG. 20
FIG. 21
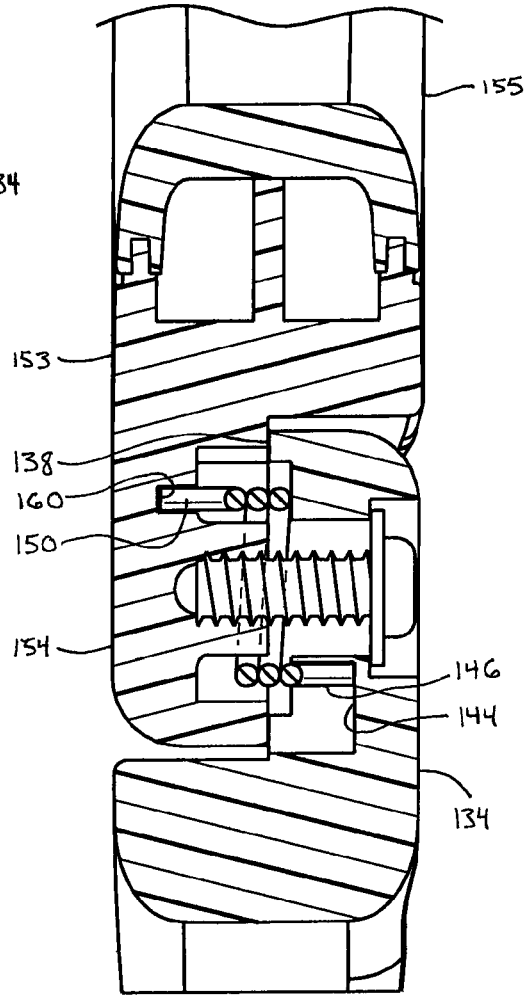

CABLE CLASP

CROSS-REFERENCE TO RELATED APPLICATION

This application claims the benefit of U.S. Provisional Patent Application No. 61/151,420 filed Feb. 10, 2009, the disclosure of which is hereby incorporated by reference in its entirety.

STATEMENT CONCERNING FEDERALLY SPONSORED RESEARCH OR DEVELOPMENT

Not applicable.

FIELD OF THE INVENTION

This invention relates to cable clasps, and in particular to a releasable clasp that is particularly adapted for supporting bundles or loops of one or more elongated articles, such as electrical cords.

BACKGROUND OF THE INVENTION

Cable ties are well-known and typically inexpensive single-use devices for supporting loops of one or more elongated articles, such as electrical cords, ropes, garden hoses, and the like. Most cable tie designs include a tail with a plurality of teeth that engage a head when the tail and the head are moved together to form a closed-loop. The head includes a pawl or lip that engages one or more teeth to prevent the tail from disengaging the head. Most cable tie designs are cut and discarded after use or when the article is to be unwound.

Cable clasps are also well-known and typically more expensive than cable ties; however, most cable clasps are more durable than cable ties. Like cable ties, cable clasps include a tail having a plurality of teeth that engage a head to form a closed-loop and prevent the tail from disengaging the head. However, cable clasps also permit the tail to be released from the head, and therefore are reusable.

In some cases, cable clasps have similar body structures to those of some cable ties. For example, some cable clasps include a head and a tail that are integrally formed as a single-piece flexible device. In contrast, other cable clasps include separate hingedly-connected head and tail sections that are formed as relatively rigid components. In any case, previous cable clasp designs normally occupy an open-loop position in which the tail is spaced apart from the head. That is, a user must force the tail and the head together to close the loop and secure the article within the cable clasp. Such a task can be difficult to perform in certain situations. For example, it may be difficult for a single user to lift a heavy garden hose and then close a cable clasp around the hose.

The normally open-loop structure of previous cable clasp designs is also disadvantageous for several additional reasons. For example, two or more cable clasps can become "tangled" when not in use and stored together, for example, in a box or trunk; such a situation may cause difficulty and frustration for a user attempting to remove a single cable clasp. As another example, the free ends of the tail and the head do not support each other in the open-loop position, and therefore each is less durable. As such, abrupt contact between an external object and one of the free ends is more likely to damage the cable clasp in the open-loop position.

Considering the drawbacks of previous cable clasp designs, an improved cable clasp design is needed. Such an improved cable clasp is preferably easy to use and durable compared to previous designs.

SUMMARY OF THE INVENTION

In one aspect, the present invention provides a cable clasp comprising a tail forming part of a loop and including a free proximal end having an engagement face. The cable clasp further comprises a head forming another part of the loop and including a handle movably connected to the tail. The handle defines a mouth opening into which the tail is movable to permit the clasp to move from an open-loop position to a closed-loop position and vice versa. In the open-loop position the free proximal end of the tail is spaced from the mouth opening, and in the closed-loop position at least a portion of the free proximal end is disposed within the mouth opening. The head further includes a lock connected to the handle and including a catch. The catch and the engagement face are engageable in a lock position to: 1) prevent motion of the tail relative to the head in a first direction, and 2) permit motion of the tail relative to the head in a second direction opposite the first direction by sliding the catch over the engagement face. The catch and the engagement face are also disengageable in a release position to permit motion of the tail relative to the head in both the first and second directions. The cable clasp further comprises a first elastic element engaging the handle and the tail and biasing the clasp towards the closed-loop position.

In another aspect, the cable clasp comprises a tail forming part of a loop and including a free proximal end having an engagement face. The cable clasp further comprises a head forming another part of the loop. The head includes a handle movably connected to the tail that defines a mouth opening into which the tail is movable to permit the clasp to move from an open-loop position to a closed-loop position and vice versa. In the open-loop position the free proximal end of the tail is spaced from the mouth opening, and in the closed-loop position at least a portion of the free proximal end is disposed within the mouth opening. The handle includes a neck and a grip connected to the neck. The grip includes a first grip arm extending generally perpendicularly relative to a loop plane in which the tail moves relative to the handle and a second grip arm extending generally perpendicularly relative to the loop plane. The first and second grip arms are disposed on opposite sides of the neck. The head further includes a lock connected to the handle having a catch engageable with the engagement face of the tail. The catch and the engagement face are engageable in a lock position to: 1) prevent motion of the tail relative to the head in a first direction, and 2) permit motion of the tail relative to the head in a second direction opposite the first direction by sliding the catch over the engagement face. The lock and the engagement face are also disengageable in a release position to permit motion of the tail relative to the head in both the first and second directions.

In yet another aspect, the present invention provides a method for manufacturing a cable clasp, comprising the steps of: providing a tail that includes a free proximal end having an engagement face, the tail further includes a distal hinge end opposite the free proximal end, and the distal hinge end includes a hinge face that has a first torsion spring hole; providing a head that defines a mouth opening into which the free proximal end of the tail is pivotable, the head includes a distal hinge end spaced apart from the mouth opening, the distal hinge end of the head includes a hinge face having a second torsion spring hole; engaging a torsion spring with one of the tail and the head by positioning a first leg of the torsion spring within the torsion spring hole of the one of the tail and the head; and engaging the other of the tail and the head with the torsion spring by positioning the hinge face of the other of the tail and the head proximate the torsion spring and pivoting the cable clasp towards a closed-loop position such that a second leg of the torsion spring passes along the hinge face of the other of the tail and the head and then into the torsion spring hole of the other of the tail and the head.

The foregoing and advantages of the invention will appear in the detailed description which follows. In the description, reference is made to the accompanying drawings which illustrate a preferred embodiment of the invention.

BRIEF DESCRIPTION OF THE DRAWINGS

The invention will hereafter be described with reference to the accompanying drawings, wherein like reference numerals denote like elements, and:

FIG. 4 is a perspective view of a rocker jaw of the cable clasp of FIG. 1;

FIG. 5 is a perspective view of a handle of the cable clasp of FIG. 1;

FIG. 6 is a perspective view of a tail of the cable clasp of FIG. 1;

FIG. 20 is a section view along line 20-20 of FIG. 8;

FIG. 21 is a section view along line 21-21 of FIG. 16;

DETAILED DESCRIPTION OF THE INVENTION

The particulars shown herein are by way of example and only for purposes of illustrative discussion of the embodiments of the invention. The particulars shown herein are presented to provide what is believed to be the most useful and readily understood description of the principles and conceptual aspects of the invention. In this regard, no attempt is made to show structural details of the invention in more detail than is necessary for the fundamental understanding of the invention. The description taken with the drawings should make apparent to those skilled in the art how the several forms of the present invention may be embodied in practice.

Figure 1:
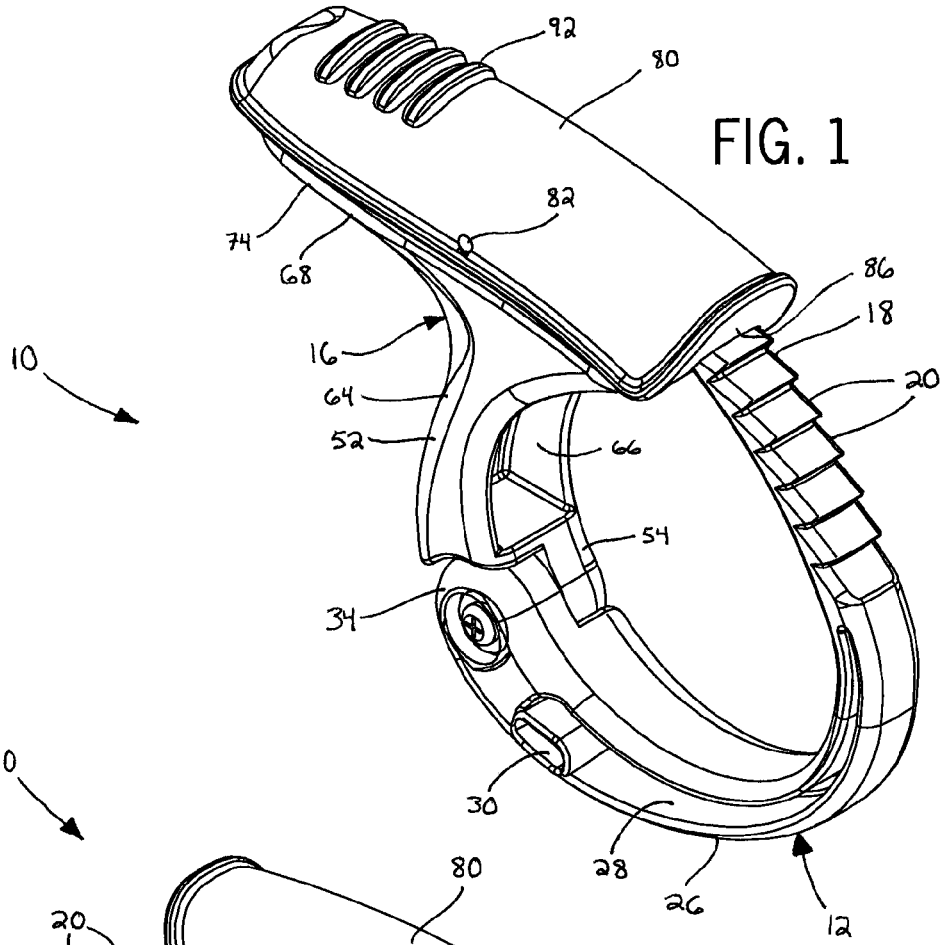
FIG. 1. is a perspective view of a first or "rocker jaw" embodiment of a cable clasp of the present invention with the cable clasp in a closed-loop position.
Figure 2:
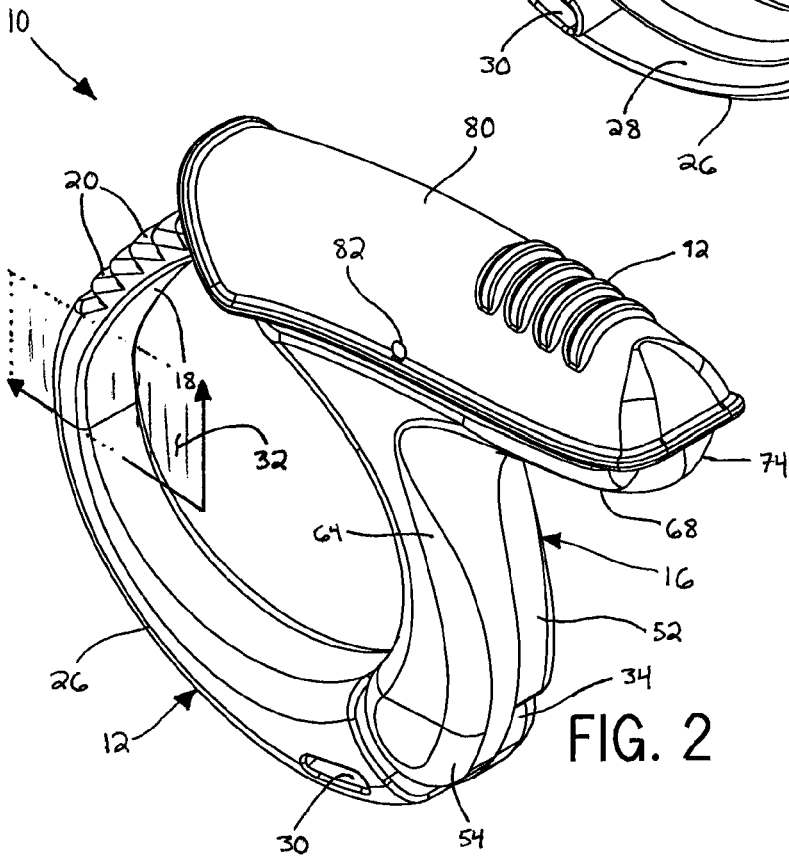
FIG. 2 is a perspective view of the cable clasp of FIG. 1 from the opposite angle.
Figure 3:
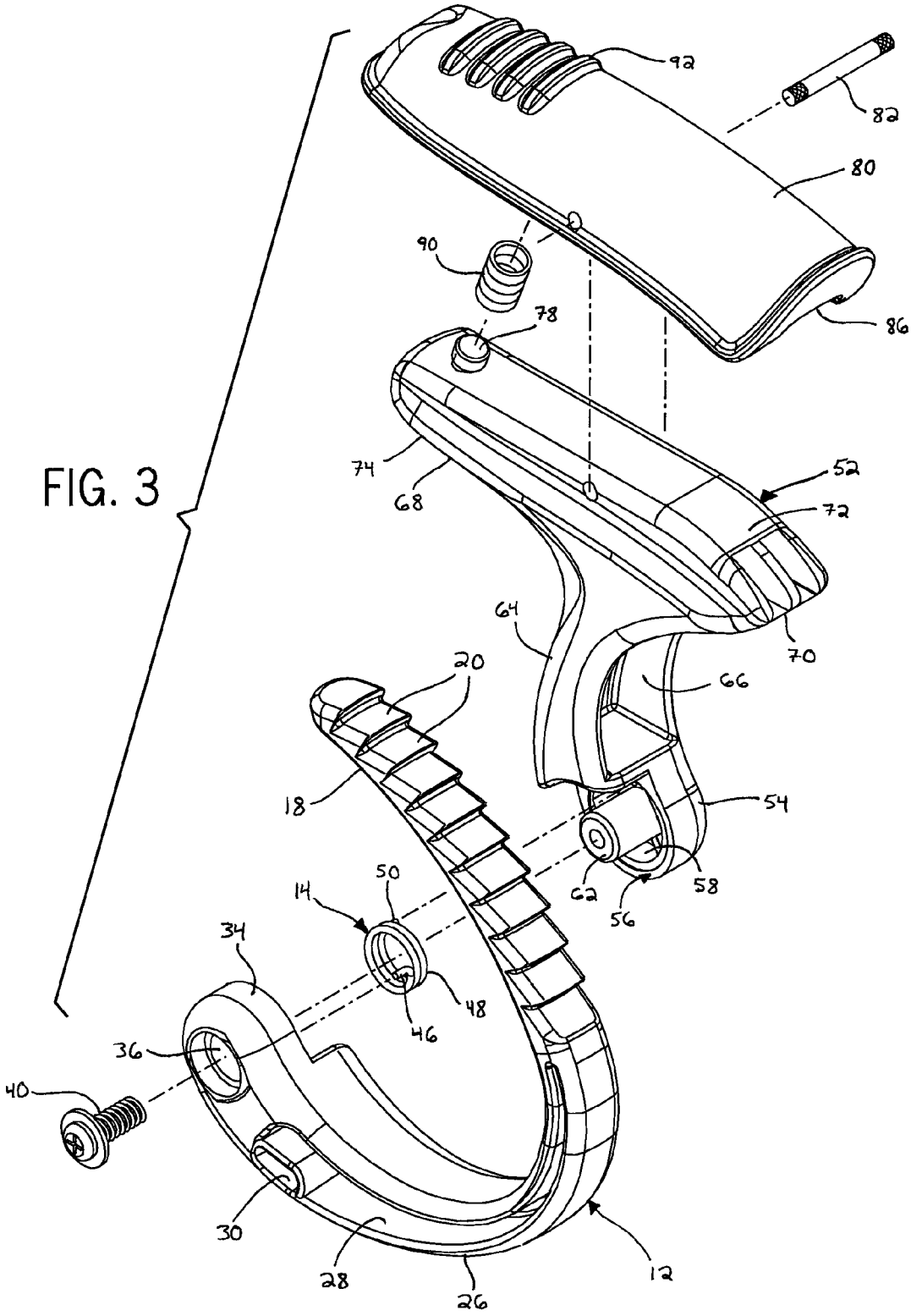
FIG. 3 is an exploded perspective view of the cable clasp of FIG. 1.
Figure 7:
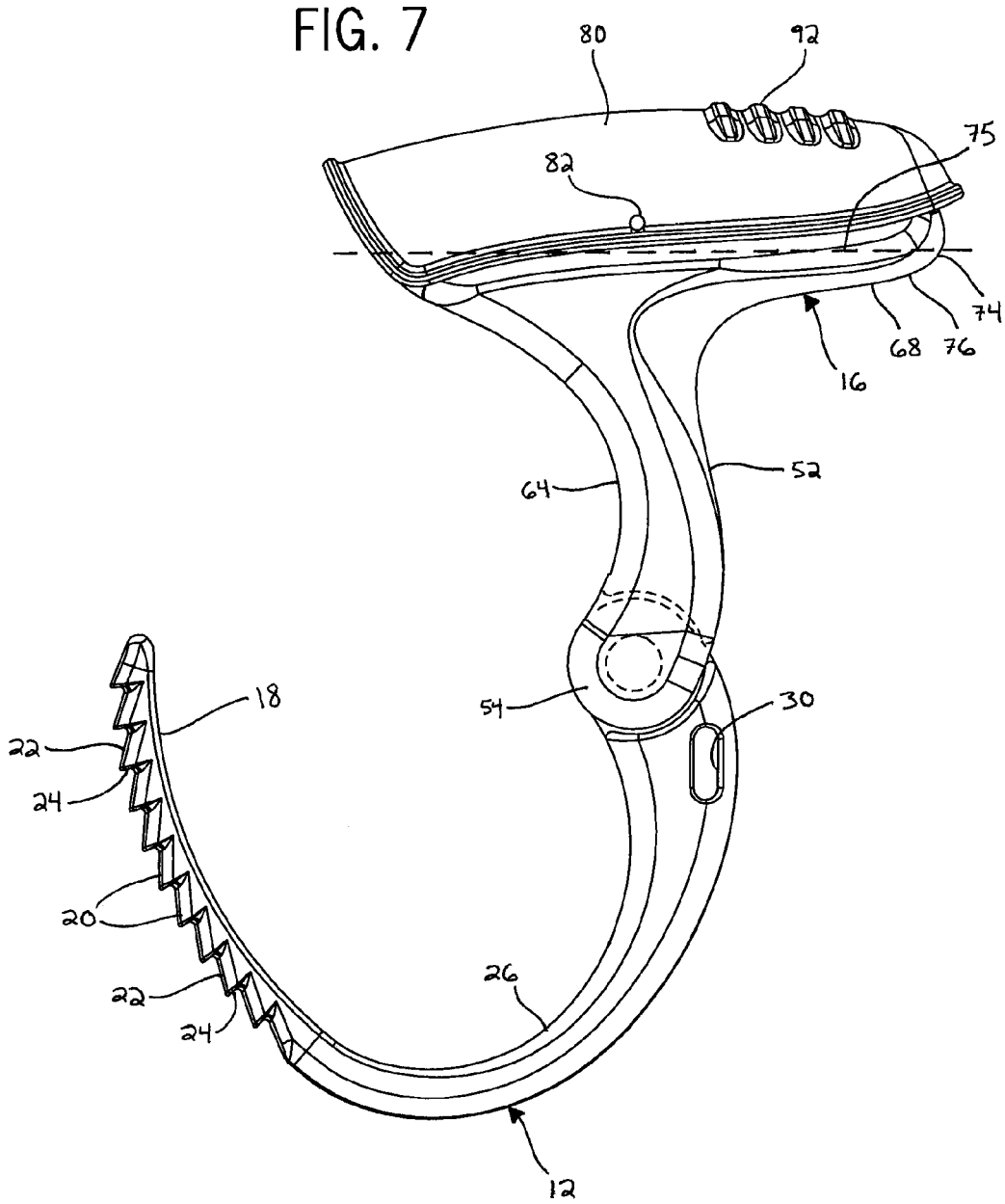
FIG. 7 is a side view of the cable clasp of FIG. 1 in an open-loop position.

Referring to FIGS. 1-9 and 20 and in particular FIGS. 1-3, a cable clasp 10 of the present invention is suitable for supporting loops of one or more elongated articles (not shown), such as electrical cords, ropes, garden hoses, and the like. However, the cable clasp 10 may also be used to support other common articles, such as plastic grocery bags, coffee mugs and the like, without departing from the scope of the invention. The cable clasp 10 includes a clasp tail 12 hingedly connected through an elastic element 14 (FIG. 3) to a clasp head 16. The tail 12 pivots between a closed-loop position (FIG. 1) in which the tail 12 enters the head 16 and a open-loop position (FIG. 7) in which an end of the tail 12 is spaced apart from the head 16. The elastic element 14 biases the tail 12 towards the closed-loop position (i.e., the elastic element 14 provides a normally closed-loop cable clasp 10). These components and their interactions are described in further detail below, beginning with the tail 12 and concluding with the head 16.

Still referring to FIGS. 1-9 and 20, the tail 12 is a generally C-shaped component forming part of the loop for supporting articles. The tail 12 includes a free proximal end 18 having a plurality of teeth 20 arranged in a series along the outer engagement face of the tail 12. In some embodiments, the teeth 20 may extend around the outer surface, side surfaces, and the inner surface of the free proximal end 18 and thereby have round cross-sectional shapes. In any case, each tooth 20 includes a diagonal ratcheting surface 22 (FIG. 7) and a locking surface 24 adjacent each ratcheting surface 22. The ratcheting surfaces 22 and the locking surfaces 24 engage and interact with the head 16 as described below.

The free proximal end 18 of the tail 12 connects to an intermediate body section 26. The intermediate body section 26 preferably increases in thickness extending away from the teeth 20 to provide a more durable tail 12. In addition, the intermediate body section 26 is preferably generally solid except for a side recess 28 that reduces the weight and cost of the tail 12. The side recess 28 may include a tie opening 30 for receiving a strap or tie (e.g., a twist-tie) for tying the cable clasp 10 to the article supported by the cable clasp 10. The opening 30 may extend in a direction perpendicular to a loop plane 32 (a vertical plane when the cable clasp 10 is stood upright as shown in the figures) in which the tail 12 pivots relative to the head 16.

Referring specifically to FIGS. 3, 6, and 20, the intermediate body section 26 of the tail 12 connects to a distal hinge end 34 opposite the free proximal end 18. The distal hinge end 34 is preferably about half the thickness of the adjacent portion of the intermediate body section 26 to provide half of a hinge between the tail 12 and the head 16. The distal hinge end 34 includes a hinge hole 36 extending from a hinge face 38 to an opposite face and accommodating a hinge fastener 40 (e.g., a threaded screw). The hinge face 38 generally faces the elastic element 14 and perpendicularly faces the loop plane 32. An annular recess 42 of the hinge face 38 surrounds the hinge hole 36 and accommodates a portion of the elastic element 14. The annular recess 42 includes a first torsion spring hole 44 for accommodating another portion of the elastic element 14 as described below.

In some embodiments, the tail 12 may include a loop or a hook (not shown) connected to the intermediate body section 26 outside of the loop. Such a feature may permit a user to easily move the tail 12 with a single finger as described in further detail below.

Referring now to FIGS. 3, 8, 9, and 20, the elastic element 14 is preferably a torsion spring. Alternatively, the elastic element 14 may be another appropriate spring design (e.g., a coil spring or the like) having an appropriate spring constant to bias the tail 12 towards the closed-loop position and thereby provide a normally-closed cable clasp 10. The torsion spring 14 includes a first leg 46 disposed within the first torsion spring hole 44 of the tail 12. The first leg 46 connects to a coiled body 48 of the torsion spring 14, a portion of which is disposed within the annular recess 42 of the tail 12. The coiled body 48 connects to a second leg 50 opposite the first leg 46. The second leg 50 engages the head 16 to bias the tail 12 towards the closed-loop position.

Referring now to FIGS. 3, 5, 7-9, and 20, the head 16 includes a generally T-shaped handle 52 forming another part of the loop for supporting articles. The handle 52 includes a distal hinge end 54 pivotally connected to the distal hinge end 34 of the tail 12. The distal hinge end 54 of the handle 52 is preferably about half the thickness of an adjacent part of the handle 52 to provide, together with the distal hinge end 34 of the tail 12, a hinge having about the same thickness as adjacent parts of the cable clasp 10. The distal hinge end 54 of the handle 52 includes a hinge face 56 abuttingly engaged against the hinge face 38 of the tail 12 (i.e., perpendicularly facing the loop plane 32). A generally annular recess 58 of the hinge face 56 accommodates a portion of the coiled body 48 of the torsion spring 14. In addition, the recess 58 includes a second torsion spring hole 60 for accommodating the second leg 50 of the torsion spring 14. A hinge post 62 of the hinge face 56 is disposed within the coiled body 48 of the torsion spring 14 and the hinge hole 36 of the tail 12. The hinge post 62 also engages the hinge fastener 40 and extends from the recess 58 generally perpendicularly away from the loop plane 32.

The positions of the first and second torsion spring holes 44, 60 about the axis of the hinge are preferably selected in conjunction with the positions of the first and second torsion spring legs 46, 50. That is, the positions of the first and second torsion spring holes 44, 60 should be selected such that the torsion spring 14 is in an unloaded position when the tail 12 is in the closed-loop position. In addition, these positions are also preferably selected in conjunction with the spring constant of the torsion spring 14 and friction between the hinge components to ensure the cable clasp 10 is normally in the closed-loop position.

The distal hinge end 54 of the handle 52 connects to a neck 64 that may include a neck recess 66 to reduce the weight and cost of the head 16. As shown in the figures, the neck recess 66 may generally face a direction along the loop plane 32. The neck 64 connects to a grip 68 opposite the distal hinge end 54. The grip 68 is an elongated section whose largest dimension defines a major axis 75 (FIG. 7) of the handle 52 that is generally parallel to the loop plane 32. The grip 68 includes a proximal section 70 having a sloped upper surface 72 to avoid contact with the tail 12. The proximal section 70 is disposed opposite a distal section 74 of the grip 68. The distal section 74 includes a lower surface 76 that may be grasped by a user as described in further detail below. The distal section 74 further includes a diagonally-extending spring post 78 opposite the graspable lower surface 76.

Figure 8:
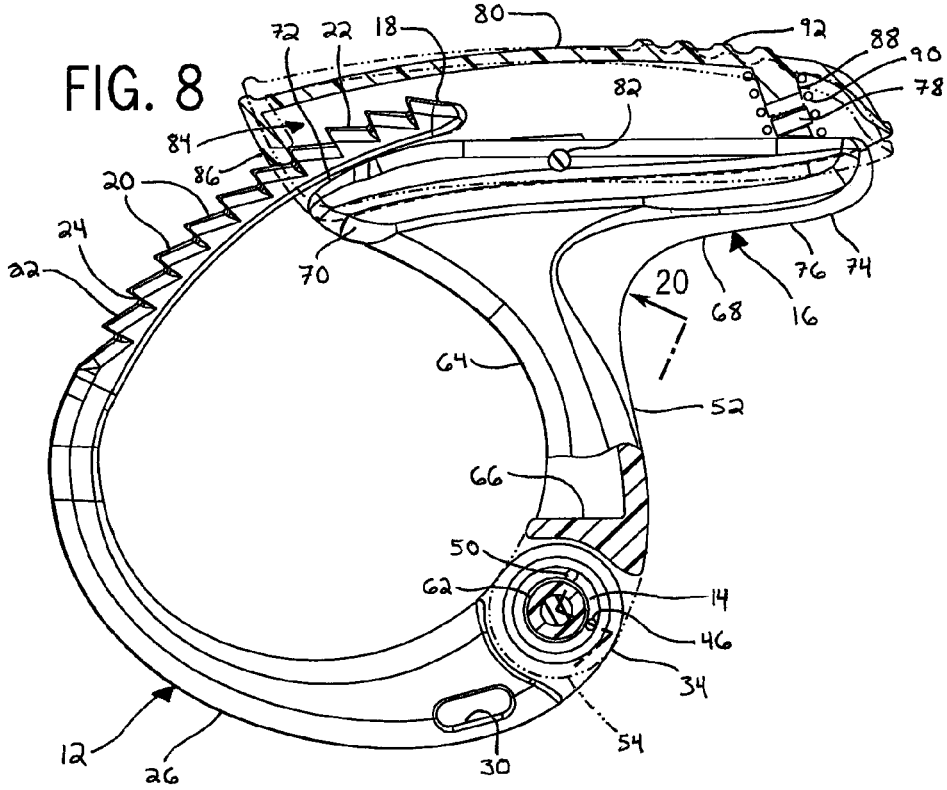
FIG. 8 is a side view of the cable clasp of FIG. 1 in the closed-loop position and with portions of the rocker jaw and the handle shown in section.
Figure 9:
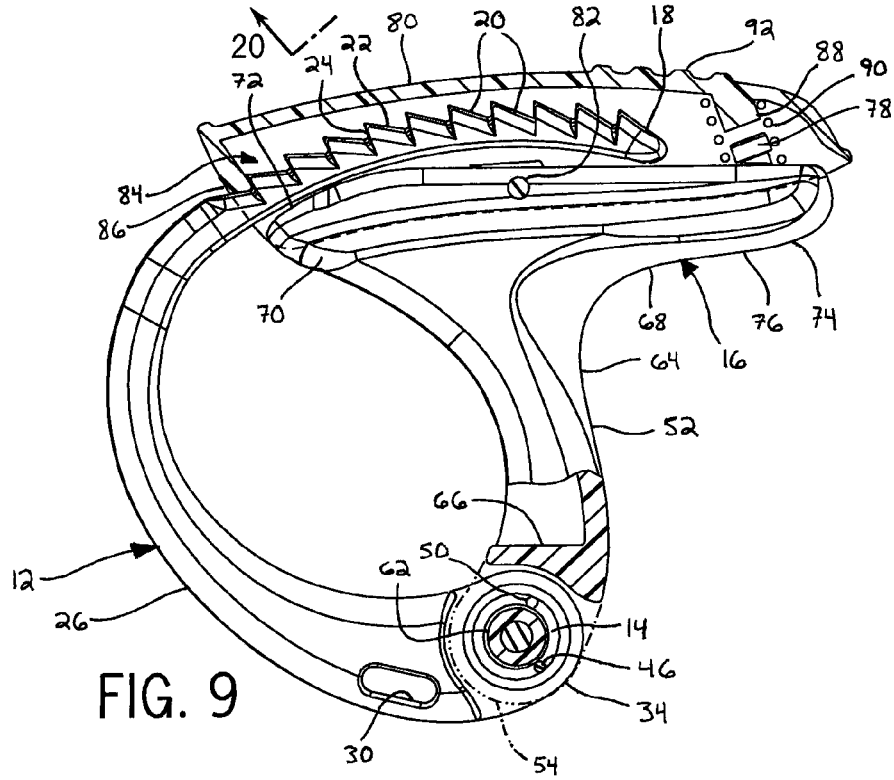
FIG. 9 is a side view of the cable clasp like FIG. 8 but with the tail rotated further into the closed-loop position.
Figure 10:
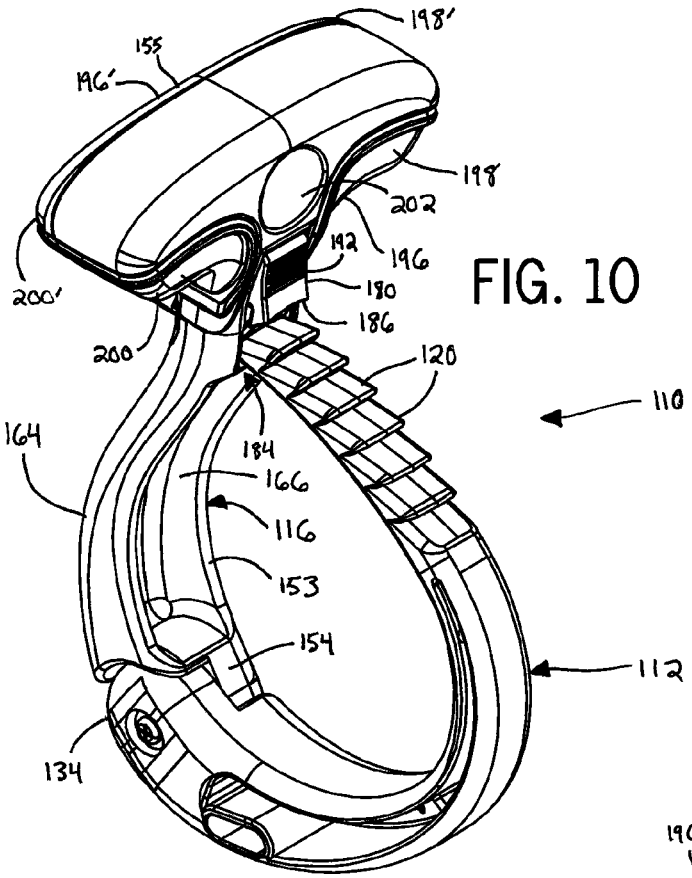
FIG. 10 is a perspective view of a second or "T-handle" embodiment of a cable clasp of the present invention with the cable clasp in a closed-loop position.
Figure 11:
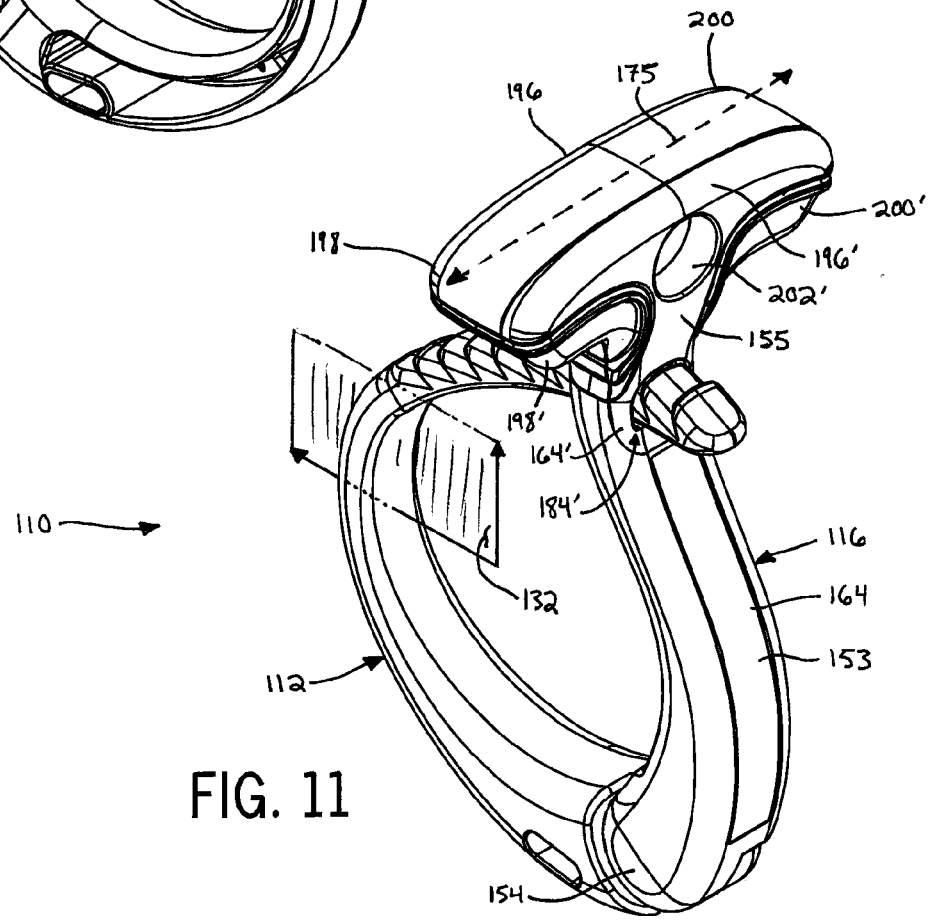
FIG. 11 is a perspective view of the cable clasp of FIG. 10 from the opposite angle.

Referring now to FIGS. 3, 4, 7-9, the head 16 further includes a rocker jaw 80 that acts as a lock. The jaw 80 pivotally connects to the grip 68 by a pin 82 disposed between the proximal section 70 and the distal sections 74 of the grip 68. The pin 82 generally extends in a direction perpendicular to the loop plane 32, and therefore, the rocker jaw 80 pivots within the loop plane 32 as shown in FIG. 8. In general, the rocker jaw 80 is an elongated shell-like component extending over the length of the grip 68. The rocker jaw 80 defines an internal mouth opening 84 together with the upper surface 72 of the handle 52. As shown most clearly in FIGS. 8 and 9, the mouth opening 84 accommodates the free proximal end 18 of the tail 12 in the closed-loop position.

A proximal end of the rocker jaw 80 includes a lip 86 acting as a catch for engaging the teeth 20 on the tail 12. Specifically, in the closed-loop position, the lip 86 engages the locking surface 24 of one of the teeth 20 to prevent motion of the tail 12 relative to the head 16 when attempting to pull the tail 12 away from the head 16. However, the lip 86 permits motion of the tail 12 relative to the head 16 when pushing the tail 12 further towards the head 16. In this case, the lip 86 slides and ratchets over the ratcheting surfaces 22 of one or more teeth 20.

The rocker jaw 80 further includes a spring post 88 disposed near a distal end opposite the lip 86. The spring post 88 is disposed within a compression spring 90 also connected to the spring post 78 of the handle 52. The compression spring 90 biases the rocker jaw 80 and the lip 86 into a ratchet/lock position in which the lip 86 engages the teeth 20 on the tail 12 as described above. Alternatively, another type of elastic element may be used to bias the lip 86 into engagement with the tail 12, such as a cantilever spring, a leaf spring, or the like. The rocker jaw 80 and the lip 86 may be pivoted to a release position by gripping the lower surface 76 of the grip 68 (e.g., with the user's index finger) and an upper grip surface 92 of the rocker jaw 80 (e.g., with the user's thumb) to compress the spring 90. As the name implies, in the release position the lip 86 disengages the teeth 20 to permit the tail 12 to pivot relative to the head 16 in either direction.

The structure and shape of the cable clasp of the present invention may be modified from the above description without departing from the scope of the invention. For example and referring now to FIGS. 10-19 and 21, a second embodiment of the cable clasp 110 includes a T-handle structure that may be easier to carry and connect to a support structure in some situations. The cable clasp 110 includes a clasp tail 112 hingedly connected through an elastic element 114 to a T-shaped clasp head 116.

The C-shaped clasp tail 112 includes a plurality of teeth 120 and is generally as described above. However, the distal hinge end 134 of the tail 112 includes a hinge face 138 having an elongated first torsion spring hole 144 to simplify assembly as described in further detail below. The distal hinge end 134 of the tail 112 connects to the elastic element 114. As described above, the elastic element 114 is preferably a torsion spring 114 including a first leg 146 disposed within the first torsion spring hole 144 of the tail 112. The torsion spring 114 further includes a second leg 150 opposite the first leg 146. The torsion spring 114 connects to the head 116 of the cable clasp 110 opposite the tail 112.

Figure 12:
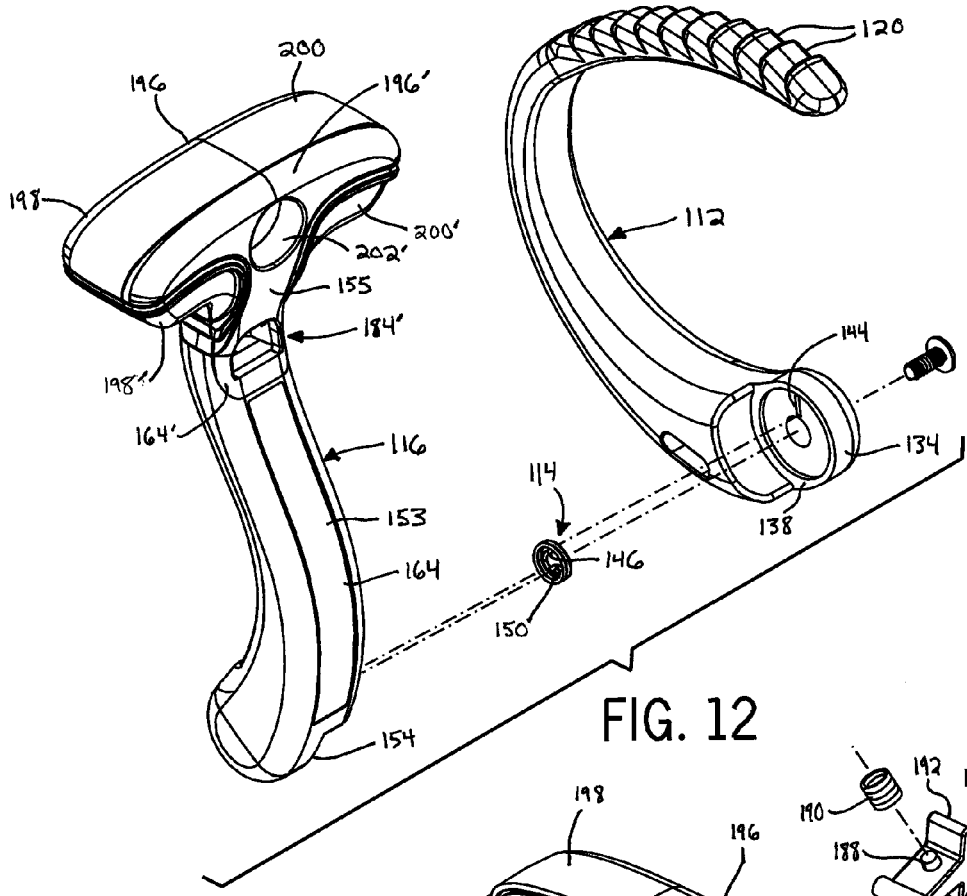
FIG. 12 is an exploded perspective view of the cable clasp of FIG. 10.
Figure 13:
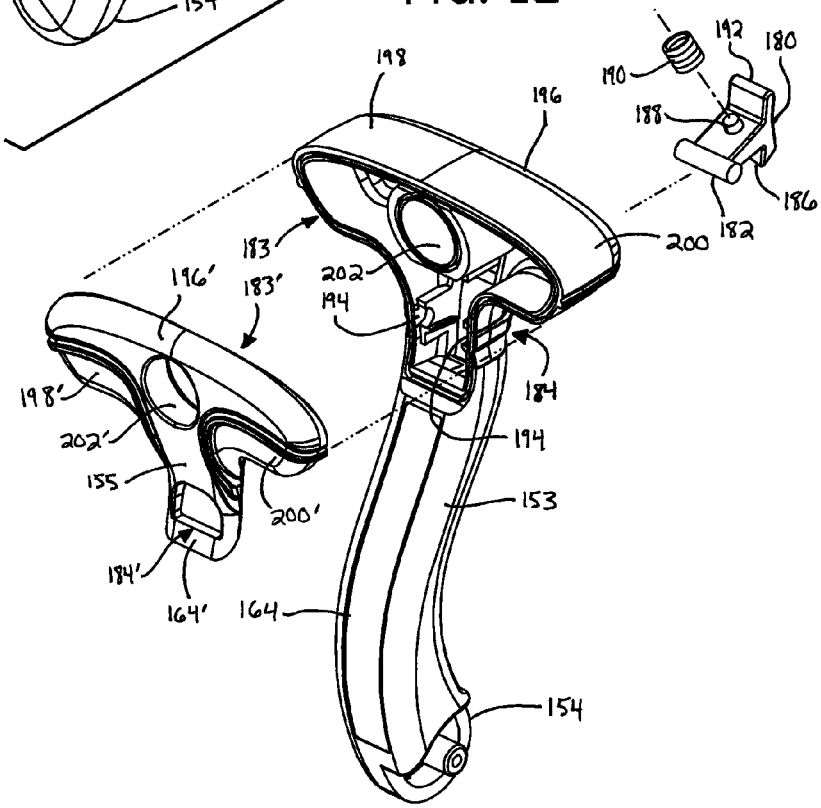
FIG. 13 is an exploded perspective view of a head of the cable clasp of FIG. 10.
Figure 14:
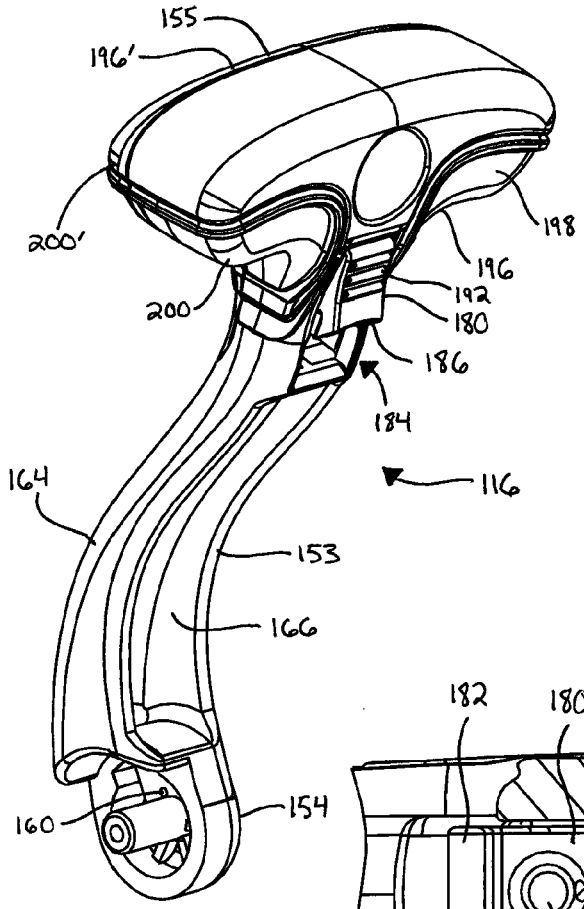
FIG. 14 is a perspective view of the head of FIG. 13.
Figure 18:
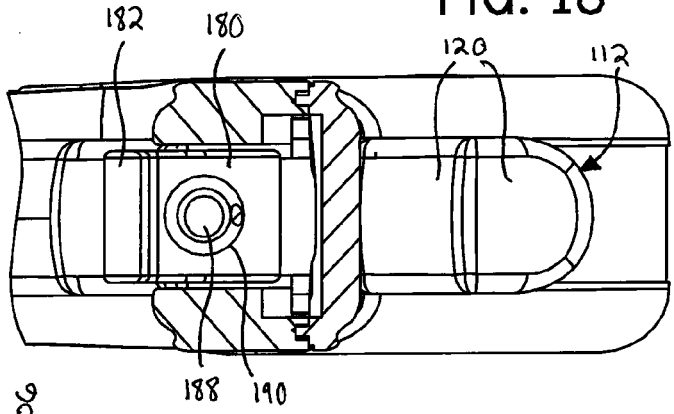
FIG. 18 is a section view along line 18-18 of FIG. 16.

Referring now to FIGS. 12-14, the head 116 includes a handle housing 153 having a distal hinge end 154 pivotally connected to the distal hinge end 134 of the tail 112. The distal hinge end 154 includes a second torsion spring hole 160 (FIGS. 14 and 21) for accommodating the second leg 150 of the torsion spring 114.

The distal hinge end 154 connects to an elongated neck 164 of the handle housing 153. The neck 164 may include a neck recess 166 to reduce the weight and cost of the head 116. The neck 164 also includes a mouth opening 184 spaced apart from the distal hinge end 154 of the handle housing 153. The mouth opening 184 accommodates the tail 112 in the closed-loop position. Pivot grooves 194 (FIG. 13) are disposed near an open face 183 of the neck 164 opposite the mouth opening 184. A spring post 178 (FIGS. 16 and 17) is disposed above the pivot grooves 194 and within the mouth opening 184. These features are described in further detail below.

Still referring to FIGS. 12-14, the neck 164 supports a grip 196 above the mouth opening 184. The grip 196 includes a first grip arm 198 extending generally perpendicularly relative to a loop plane 132 (FIG. 11) in which the tail 112 pivots relative to the head 116. The grip 196 also includes a second grip arm 200 extending generally perpendicularly relative to the loop plane 132 but in the opposite direction from the first grip arm 198. The grip 196 further includes a hole 202 extending through the grip 196 between the first and second grip arms 198, 200. The hole 202 is configured to accommodate an external post 204 (FIG. 19) for supporting the cable clasp 110 on a support structure, e.g., a wall 206.

The handle housing 153 connects to a handle cover 155. The handle cover 155 is a generally T-shaped component; that is, the handle cover 155 includes features similar to some of those of the handle housing 153. The handle cover 155 also includes an open face 183' facing the open face 183 of the handle housing 153. Similarly, the handle cover 155 includes a relatively short neck 164' defining a mouth opening 184', a through hole 202', and supports a grip 196' having grip arms 198' and 200'. Each of these sections generally compliments and interfaces those of the handle housing 153 to provide a generally T-shaped head 116.

Figure 19:
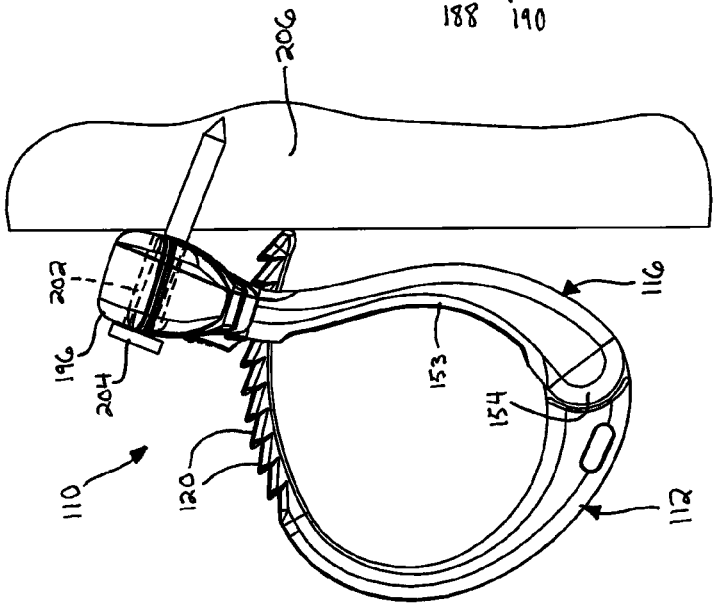
FIG. 19 is a side view of the cable clasp of FIG. 10 supported by a nail in a wall.
Figure 15:
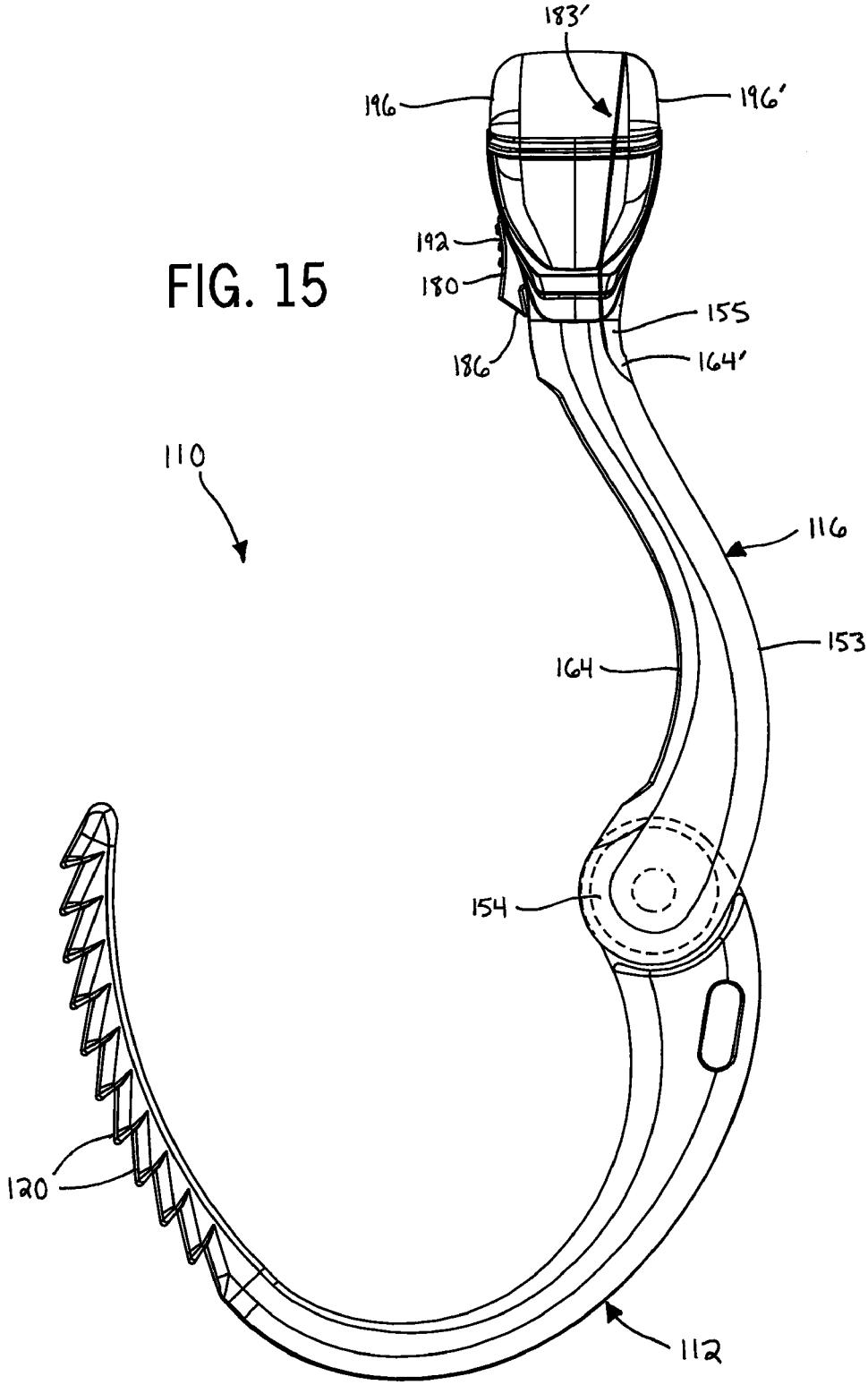
FIG. 15 is a side view of the cable clasp of FIG. 10 in an open-loop position.
Figure 16:
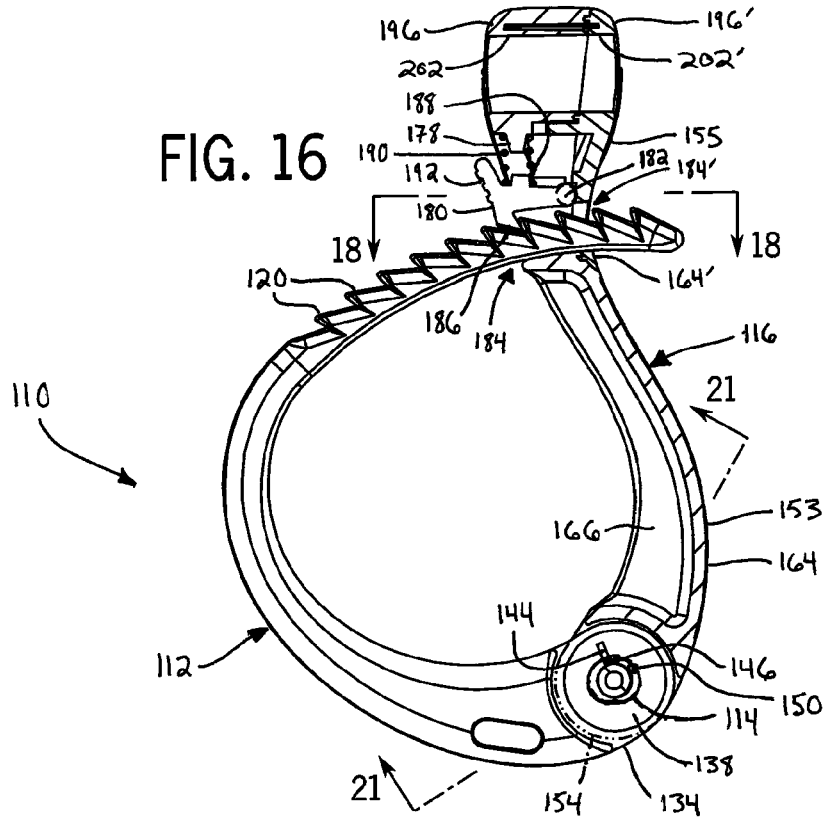
FIG. 16 is a side view of the cable clasp of FIG. 10 in the closed-loop position and with portions of the head shown in section.
Figure 17:
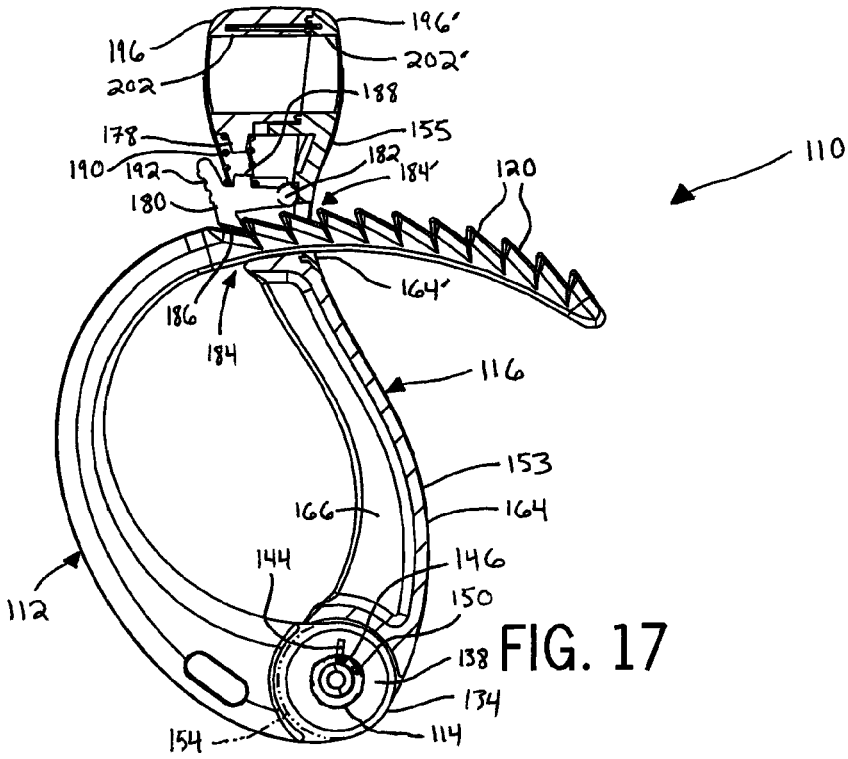
FIG. 17 is a side view of the cable clasp like FIG. 16 but with the tail rotated further into the closed-loop position.

The largest dimension of the elongated grips 196, 196' defines a major axis 175 (FIG. 11) of the head 116 that is generally perpendicular to the loop plane 132. Such a design advantageously provides a cable clasp 110 with an improved carrying orientation. That is, the cable clasp 110 is easy to balance and grasp, e.g., by holding the first and second grips arms 198 and 200 with the index and middle fingers, respectively. Similarly, the through holes 202, 202' extend through the grips 196, 196' generally perpendicularly to the major axis 175. Such a design advantageously permits the cable clasp 110 to be securely positioned adjacent the support structure 206 (FIG. 19).

Referring now to FIGS. 12-14 and 16-17, the handle housing 153 and the handle cover 155 pivotally support a generally T-shaped jaw 180 there between. A first leg of the jaw 180 includes a pivot pin 182 that pivots in the pivot grooves 194 in the handle housing 153. The pivot pin 182 permits the jaw 180 to pivot between a release position and a ratchet/lock position like the first embodiment of the cable clasp 10. A second leg of the jaw 180 includes a lip 186 for engaging the teeth 120 on the tail 112 in the ratchet/lock position like the first embodiment of the cable clasp 10. A third leg of the jaw 180 includes a release button 192 that may be manipulated by the user to move the jaw 180 to the release position. The jaw 180 also includes a spring post 188 opposite the spring post 178 on the handle housing 153. The spring posts 178, 188 support a compression spring 190 biasing the jaw 180 towards the ratchet/lock position.

Figure 22:
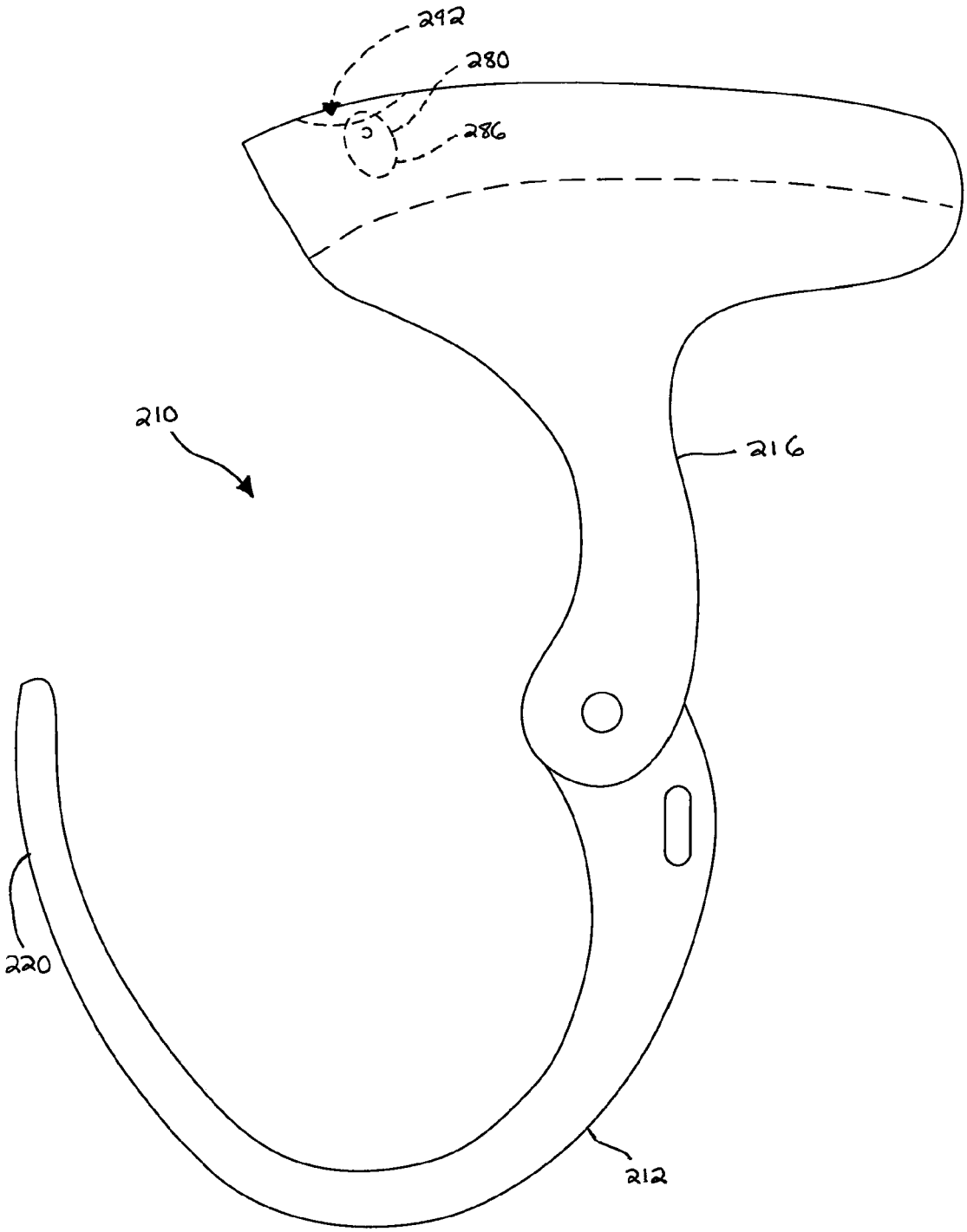
FIG. 22 is a side view of a third or "cam lock" embodiment of a cable clasp of the present invention with the cable clasp in an open-loop position.
Figure 23:
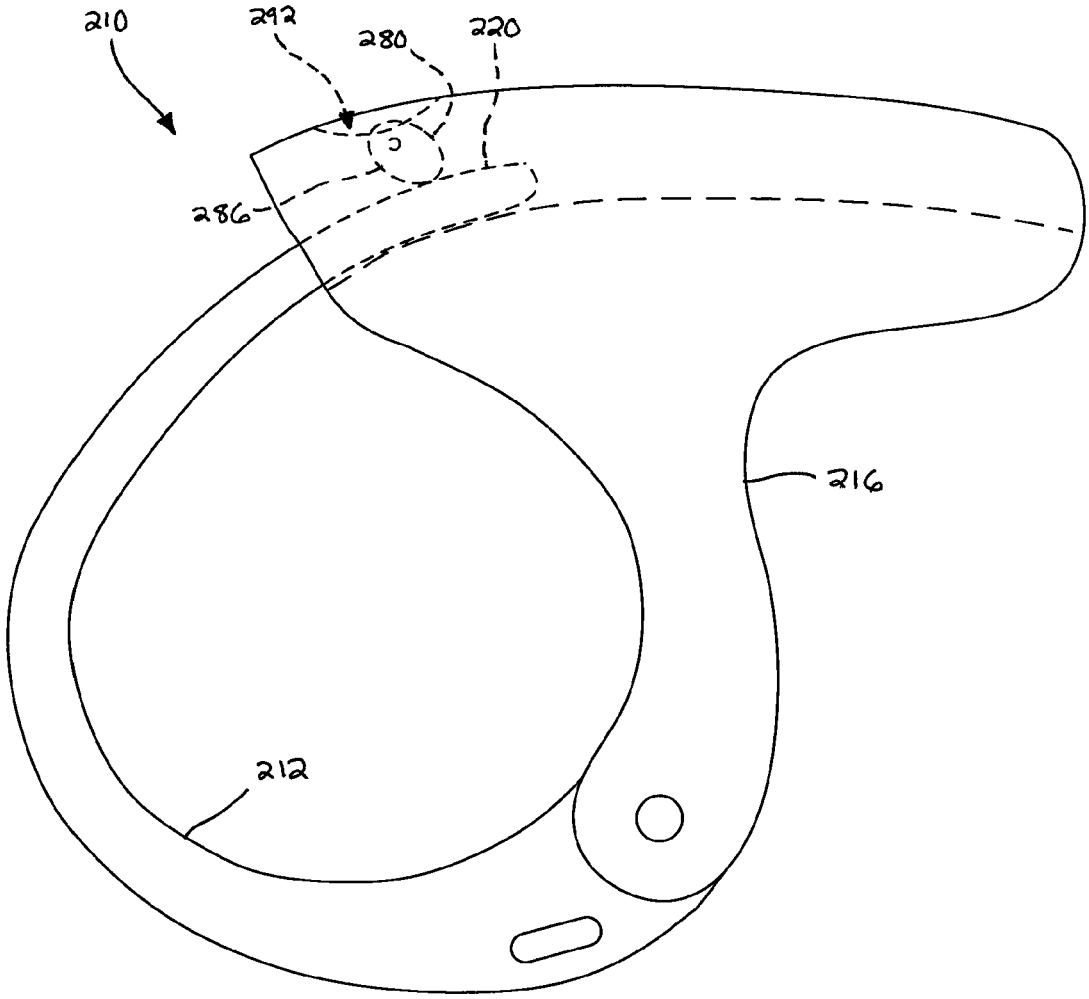
FIG. 23 is a side view of the cable clasp of FIG. 22 in a closed-loop position.
Figure 24:
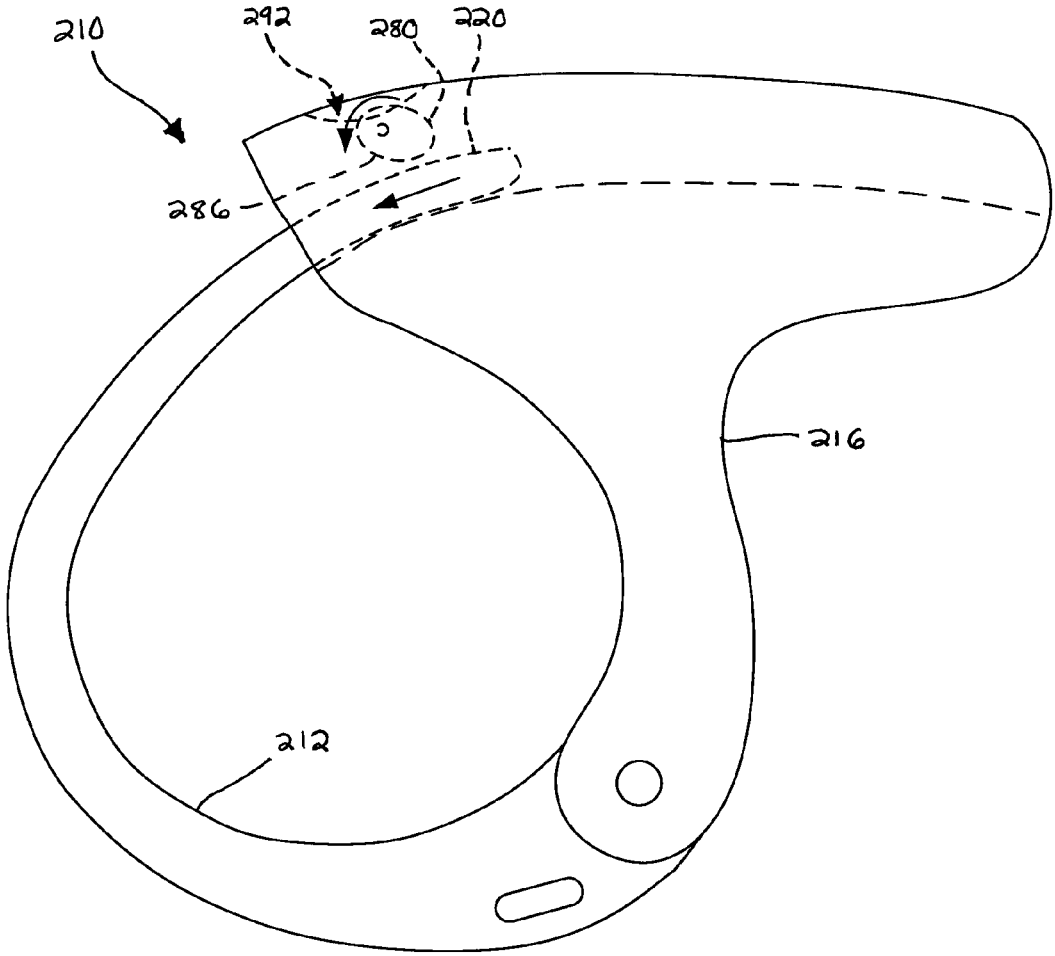
FIG. 24 is a side view of the cable clasp of FIG. 22 with a jaw rotated to a release position.

Referring now to FIGS. 22-24, a third embodiment of the cable clasp 210 is shown having a rocker jaw-type grip as described above, although a T-handle grip may alternatively be used. The cable clasp 210 includes a clasp tail 212 hingedly connected through an elastic element (not shown) to a rocker jaw-type head 216. Unlike the embodiments described above, the tail 212 includes a curved outer engagement face 220 without teeth. As shown in FIG. 23, in the closed-loop position the engagement face 220 of the tail 212 engages a cam 280 pivotally supported by the head 216. The cam 280 may be an eccentric cam, a non-circular cam, an eccentric non-circular cam, or the like. In any case, the cam 280 is preferably a material that has a high coefficient of friction with the engagement face 220 of the tail 212, such as rubber, urethane, or the like, to provide a lock for locking against the tail 212 in some positions. That is, the surface 286 of the cam 280 acts as a catch in the lock position, and friction between the cam 280 and the engagement face 220 prevents the tail 212 from being moved out of the head 216. However, the tail 212 may be moved further into the closed-loop position by forcing the tail 212 and the head 216 together, thereby causing the engagement face 220 to slide over the surface 286 of the cam 280. In addition and referring to FIG. 24, a user may place a finger within a cam opening 292 and rotate the cam 280 to the release position and disengage the cam 280 from the tail 212. The tail 212 may then be moved to the open-loop position. In some embodiments, the head 216 may house an elastic element (not shown), such as a torsion spring or the like, that biases the cam 280 toward the lock position.

Unlike the embodiments described above, the cable clasp 210 is adjustable over an infinite range of positions. Furthermore, the hinge surfaces between the tail 212 and the head 216 may include teeth-like structures that provide a "ratcheting" sound as the tail 212 moves relative to the head 216.

Figure 25:
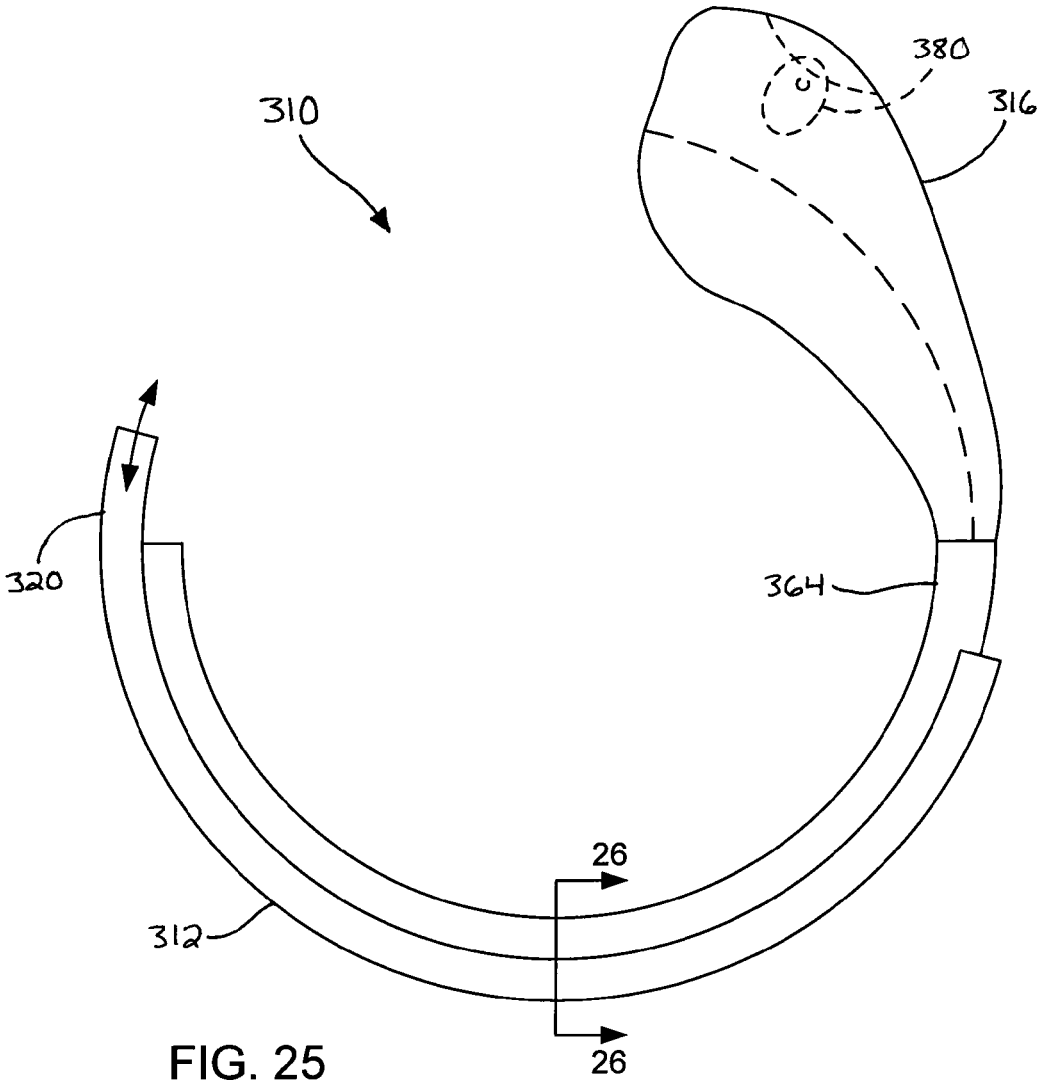
FIG. 25 is a side view of a fourth or "circle" embodiment of a cable clasp of the present invention with the cable clasp in an open-loop position.
Figure 26:
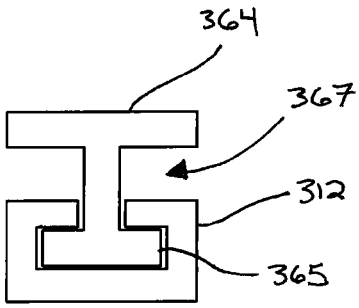
FIG. 26 is a section view along line 26-26 of FIG. 25.
Figure 27:
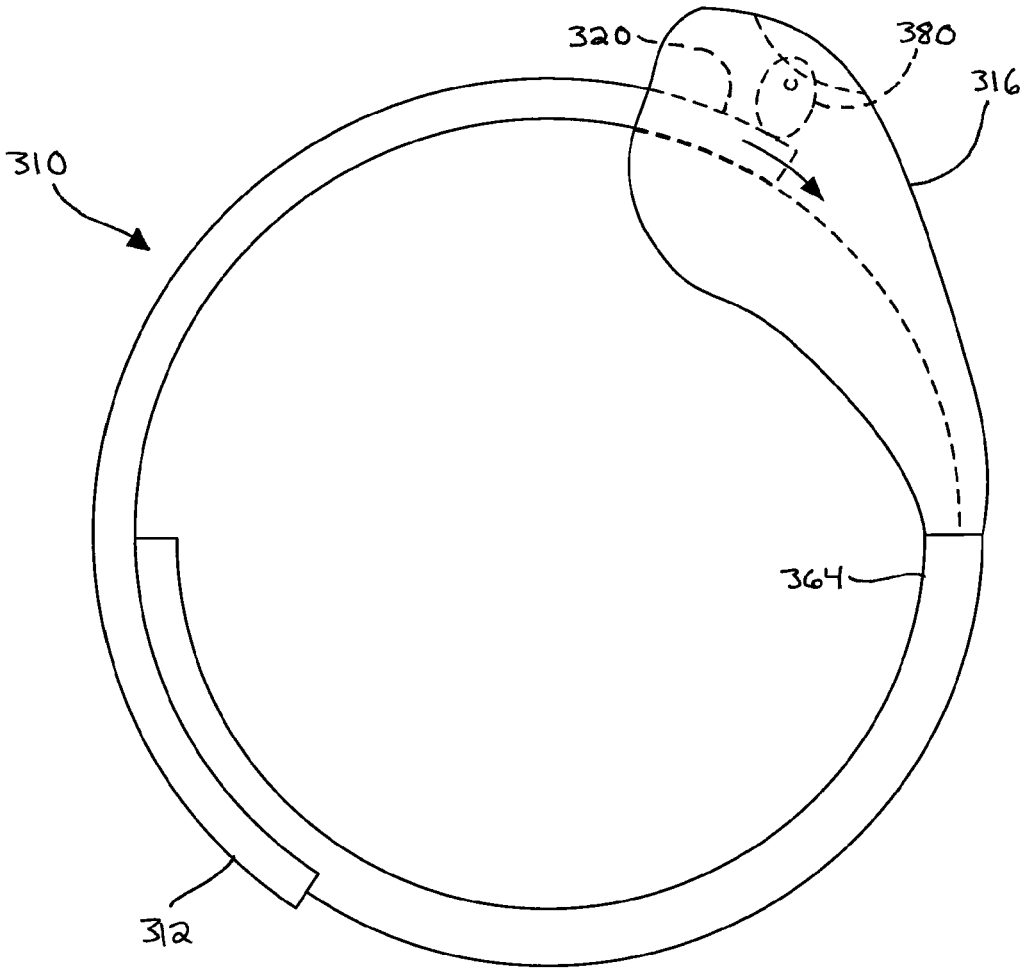
FIG. 27 is a side view of the cable clasp of FIG. 25 in a closed-loop position.

Referring now to FIGS. 25-27, a fourth embodiment of the cable clasp 310 is shown having a relatively small head 316, although the head 316 may include an elongated grip as described above in connection with the rocker jaw-type handle and the T-handle. The head 316 includes an arcuate neck 364 that may have an "I-beam" shaped cross-section as shown in FIG. 26. Unlike the embodiments described above, the neck 364 slidably supports the tail 312 to permit the tail 312 to move about an arcuate path between the open-loop position (FIG. 25) and the closed-loop position (FIG. 27). As shown in FIG. 26, the tail 312 may have a channel shape that surrounds a lower foot 365 of the neck 364. The head 316 preferably includes a cam 380 for engaging the engagement face 320 of the tail 312 as described above. Alternatively, the head 316 may include a jaw having a lip for engaging a plurality of teeth on the tail 312. In addition, the cable clasp 310 may include a spring (not shown), such a compression spring or the like, to bias the tail 312 towards the closed-loop position. Such a spring may be disposed within a channel 367 of the neck 364.

Figure 28:
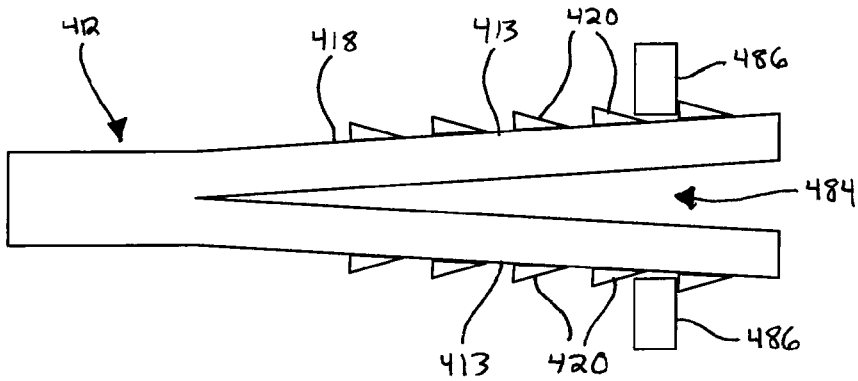
FIG. 28 is a side view of a split tail embodiment of a tail of the cable clasp of the present invention.

Referring now to FIG. 28, the embodiments described above, particularly those in which the proximal end of the tail is accessible to the user in the closed-loop position (i.e., the T-handle cable clasp 110), may include a split tail 412 having a proximal end 418 with two legs 413 that are biased apart by an internal preload, an external spring, or the like. Each of the legs 413 includes an outer engagement face having a plurality of teeth 420 as described above. In the lock position, each set of teeth 420 engages a catch or lip 486 disposed outside the mouth opening 484. The user may grasp and force the legs 413 together to disengage the teeth 420 and the lips 486 (i.e., move the tail 412 to the release position). Alternatively, the cable clasp may include a trigger (not shown) that is pressed by the user to disengage the legs 413 from the lips 486. In either case, the tail 412 may then be moved to the open-loop position.

The cable clasp 10 may be used as follows. The cable clasps 110, and 210 may also be used as follows; however, only components of the first embodiment of the cable clasp 10 are referenced for simplicity. First, a user grips the head 16 and moves the jaw 80 to the release position with a first hand. Next, the user pivots the tail 12 from the closed-loop position to the open-loop position using a second hand. Thereafter, the cable clasp 10 is held using only the first hand; specifically, the thumb and index finger are placed against the neck 164 of the handle 52 and the middle finger is placed against the tail 12 to hold the cable clasp 10 in the open-loop position. The user places an article within the open loop between the tail 12 and the head 16 using the second hand. Next, the middle finger of the first hand is released from the tail 12 to permit the torsion spring 14 to move the tail 12 towards the closed-loop position. The second hand or the middle finger of the first hand is then used to push the tail 12 an appropriate distance into the mouth opening 184 to ensure the article is secure within the cable clasp 10. Finally, the cable clasp 10 is placed on an external post or hook.

Alternatively, the cable clasp 10 may be used as follows if the tail 12 includes a loop or hook (not shown) for accommodating a single finger of a user as described above. The cable clasps 110, 210 may also be used as follows; however, only components of the first embodiment of the cable clasp 10 are referenced for simplicity. First, a user grips the head 16 and moves the jaw 80 to the release position with the index finger and the thumb of a first hand. Next, the user pivots the tail 12 from the closed-loop position to the open-loop position by pulling the hook or loop using the little finger of the first hand. Thereafter, the cable clasp 10 is held using the first hand, and the user places an article within the open loop using a second hand. Next, the little finger of the first hand is released from the tail 12 to permit the torsion spring 14 to move the tail 12 towards the closed-loop position. The second hand is then used to push the tail 12 an appropriate distance into the mouth opening 184 to ensure the article is secure within the cable clasp 10. Finally, the cable clasp 10 is placed on an external post or hook.

The cable clasp 10 is preferably assembled as follows. The cable clasps 110, 210 are also preferably assembled as follows; however, only components of the first embodiment of the cable clasp 10 are referenced for simplicity. First, the tail 12, the handle 52 (or the handle housing 153 and the housing cover 155), and the jaw 80 are formed from plastic materials, such as polystyrene or ABS, in injection molding processes. Some of these components (e.g., the handle housing 153 and the housing cover 155) may be formed as separate halves or sections that are subsequently connected in processes such as ultrasonic welding and the like. Next, the compression spring 90 and the pin 82, which are both preferably a metal such as stainless steel, are engaged with the handle 52 and the jaw 80. In the case of the cable clasp 110, the jaw 180 is inserted between the handle housing 153 and the handle cover 155 before connecting the housing and the cover 153, 155.

The torsion spring 14, which is preferably a metal such as stainless steel, is then engaged with the head 16 by positioning the coiled body 48 about the hinge post 62 and the second leg 50 in the second torsion spring hole 60. Next, the tail 12 is connected to the head 16 by placing the hinge hole 36 of the tail 12 about the hinge post 62 of the head 16. However, the tail 12 and the head 16 are connected in the open-loop position (FIG. 7) such that the first leg 46 is not aligned with and does not immediately enter the first torsion spring hole 44 of the tail 12. The tail 12 is then gently pressed against the head 16 and rotated to the closed-loop position (FIG. 1) to permit the first leg 46 to pass along the hinge face 38 (specifically, the annular recess 42) of the tail 12. The first leg 46 moves into and engages the first torsion spring hole 44 as the teeth 20 move through the mouth opening 84.

Such a method is simpler than attempting to align the first leg 46 and the first torsion spring hole 44 when the tail 12 and the head 16 are first connected. As noted above, the cable clasp 110 may include an elongated first torsion spring hole 144. Such a large elongated hole 144 further simplifies assembly by ensuring that the first leg 46 enters the hole 144. Finally, the hinge fastener 40, which is preferably a metal such as stainless steel, is inserted into the hinge hole 36 and engaged with the hinge post 62 to secure the tail 12 to the head 16. It should be noted that the cable clasp 10 can be assembled by first connecting the torsion spring 14 to the tail 12, although such an alternative would be more practical if the tail 12 included the hinge post 62 and the head 16 included the hinge hole 36. That is, the torsion spring 14 is preferably first connected to the component including the hinge post 62 to provide stability for the torsion spring 14 when the tail 12 and the head 16 are connected.

From the above disclosure, it should be apparent that the present invention provides a cable clasp that are easier to use than previous designs. The cable clasp is biased towards the closed-loop position, and therefore, the clasp is easily storable with other clasps. In addition, the cable clasp is more durable when not in use because the free ends of the tail and the head support each other.

A preferred embodiment of the invention has been described in considerable detail. Many modifications and variations to the preferred embodiment described will be apparent to a person of ordinary skill in the art. Therefore, the invention should not be limited to the embodiment described.

We claim:

1. A cable clasp for supporting an article, comprising:

a tail forming part of a loop and including a free proximal end having an engagement face, and the tail including a distal hinge end opposite the free proximal end;

a head forming another part of the loop, the head including:

a handle including a distal hinge end pivotally connected to the distal hinge end of the tail, the handle defining a proximal mouth opening and distal mouth opening together providing a passageway into which the tail is movable to permit the clasp to move from an open-loop position to a closed-loop position and vice versa, in the open-loop position the free proximal end of the tail being spaced from the passageway, in the closed-loop position at least a portion of the free proximal end being disposed within the passageway, and the free proximal end of the tail passing through the proximal mouth opening to enter the passageway when moving from the open-loop position to the closed-loop position, the handle including:

a neck;

a grip connected to the neck opposite the distal hinge end of the handle, the grip including a first grip arm extending generally perpendicularly relative to a loop plane in which the tail moves relative to the handle and a second grip arm extending generally perpendicularly relative to the loop plane, and the first and second grip arms being disposed on opposite sides of the neck; and a lock connected to the handle and protruding from the proximal mouth opening, the lock including a catch engageable with the engagement face of the tail, the catch and the engagement face being engageable in a lock position to:

1) prevent motion of the tail relative to the head in a first direction, and 2) permit motion of the tail relative to the head in a second direction opposite the first direction by sliding the catch over the engagement face, and the lock and the engagement face being disengageable in a release position to permit motion of the tail relative to the head in both the first and second directions.

2. The cable clasp of claim 1, further comprising an elastic element connected to the handle and the lock biasing the lock towards the lock position.

3. The cable clasp of claim 1, further comprising a torsion spring having a first leg and a second leg, the distal hinge end of the tail including a first torsion spring hole in which the first leg of the torsion spring is disposed, and the distal hinge end of the handle including a second torsion spring hole in which the second leg of the torsion spring is disposed, and at least one of the first and second torsion spring holes is an elongated slot extending in a direction parallel to the loop plane.

4. The cable clasp of claim 1, further comprising a first elastic element connected to the tail and the head biasing the clasp towards the closed-loop position.

5. The cable clasp of claim 1, wherein the lock has a T-shape including:

a first leg pivotally connected to the handle within the passageway;

a second leg including the catch; and a third leg including a release button being manipulable to pivot the lock relative to the handle.

6. The cable clasp of claim 5, further comprising a compression spring compressed between the handle and the first leg of the lock to bias the catch into engagement with the engagement face of the tail.

7. The cable clasp of claim 6, wherein the compression spring applies a force to the lock along a line of action, and the line of action extends through a portion of the loop plane enclosed together by the tail and the handle.

8. A method of manufacturing a cable clasp, comprising the steps of:

providing a tail including a free proximal end having an engagement face, the tail further including a distal hinge end opposite the free proximal end, the distal hinge end including a hinge face having a first torsion spring hole extending generally perpendicularly relative to a loop plane;

providing a head defining a mouth opening into which the free proximal end of the tail is pivotable, the head including a distal hinge end spaced apart from the mouth opening, the distal hinge end of the head including a hinge face having a second torsion spring hole extending generally perpendicularly relative to the loop plane;

engaging a torsion spring with one of the tail and the head by positioning a first leg of the torsion spring within the torsion spring hole of the one of the tail and the head; and engaging the other of the tail and the head with the torsion spring by positioning the hinge face of the other of the tail and the head proximate the torsion spring and pivoting the tail relative to the head in the loop plane such that the cable clasp moves towards a closed-loop position and a second leg of the torsion spring passes along the hinge face of the other of the tail and the head and then into the torsion spring hole of the other of the tail and the head.

9. The method of manufacturing a cable clasp of claim 8, wherein the head includes a handle having an elongated grip, a largest dimension of the elongated grip defines a major axis of the handle, the handle and the tail define a loop plane in which the tail pivots relative to the handle, and the major axis is generally perpendicular to the loop plane.

10. The method of manufacturing a cable clasp of claim 8, wherein the torsion spring biases the clasp towards the closed-loop position after the other of the tail and the head is engaged with the torsion spring.

11. A cable clasp for supporting an article, comprising:

a tail forming part of a loop and including a free proximal end having an engagement face, and the tail including a distal hinge end opposite the free proximal end;

a head forming another part of the loop, the head including:

a handle including a distal hinge end pivotally connected to the distal hinge end of the tail, the handle defining a proximal mouth opening and a distal mouth opening providing a passageway into which the tail is movable to permit the clasp to move from an open-loop position to a closed-loop position and vice versa, in the open-loop position the free proximal end of the tail being spaced from the passageway, in the closed-loop position at least a portion of the free proximal end being disposed within the passageway, and the free proximal end of the tail passing through the proximal mouth opening to enter the passageway when moving from the open-loop position to the closed-loop position, the handle including:

a neck;

a grip connected to the neck opposite the distal hinge end of the handle, the grip including a first grip arm extending generally perpendicularly relative to a loop plane in which the tail moves relative to the handle and a second grip arm extending generally perpendicularly relative to the loop plane, and the first and second grip arms being disposed on opposite sides of the neck; and a lock connected to the handle and protruding from the proximal mouth opening, the lock including a catch engageable with the engagement face of the tail, the catch and the engagement face being engageable in a lock position to:

1) prevent motion of the tail relative to the head in a first direction, and 2) permit motion of the tail relative to the head in a second direction opposite the first direction by sliding the catch over the engagement face, and the lock and the engagement face being disengageable in a release position to permit motion of the tail relative to the head in both the first and second directions;

a compression spring biasing the catch towards the lock position; and a torsion spring connected between the distal hinge end of the tail and the distal hinge end of the handle and biasing the clasp towards the closed-loop position.

12. The cable clasp of claim 11, wherein the engagement face includes a plurality of teeth facing away from the loop.

* * * * *